US009945553B2

(12) United States Patent
Van Wyk et al.

(10) Patent No.: US 9,945,553 B2
(45) Date of Patent: Apr. 17, 2018

(54) AQUEOUS WORKING FLUID STEAM GENERATION SYSTEM

(71) Applicants: Russel Duane Van Wyk, Cary, NC (US); Dennis Allen Van Wyk, Eugene, OR (US)

(72) Inventors: Russel Duane Van Wyk, Cary, NC (US); Dennis Allen Van Wyk, Eugene, OR (US)

( * ) Notice: Subject to any disclaimer, the term of this patent is extended or adjusted under 35 U.S.C. 154(b) by 116 days.

(21) Appl. No.: 14/839,909

(22) Filed: Aug. 28, 2015

(65) Prior Publication Data

US 2016/0053989 A1 Feb. 25, 2016

Related U.S. Application Data

(63) Continuation-in-part of application No. 13/311,271, filed on Dec. 5, 2011, now Pat. No. 9,121,602.
(Continued)

(51) Int. Cl.
*F22B 9/00* (2006.01)
*F22B 29/06* (2006.01)
(Continued)

(52) U.S. Cl.
CPC ..... *F22B 29/06* (2013.01); *F22B 9/12* (2013.01); *F22B 31/08* (2013.01); *F22B 35/00* (2013.01);
(Continued)

(58) Field of Classification Search
CPC ..... F24H 1/40; F24H 1/52; F22B 9/00; F22B 9/12; F22B 13/005; F22B 33/08; F22B 29/06; F22B 37/62; F22B 31/08
(Continued)

(56) References Cited

U.S. PATENT DOCUMENTS 473,251 A 4/1892 Cox
744,042 A 11/1903 Burk
(Continued)

FOREIGN PATENT DOCUMENTS

JP 178057 A 7/2007
WO 50821 A1 8/2000

OTHER PUBLICATIONS

"Series X PowerFlameX4—The Versatile 4" Diameter Burner," 2001, 2pp., X4-0101 Rev. 0303, published by Power Flame Incorporated, Parsons, Kansas; downloadd from www.powerflame.com.
(Continued)

*Primary Examiner* — Steven B McAllister
*Assistant Examiner* — Ko-Wei Lin
(74) *Attorney, Agent, or Firm* — Jay M. Brown

(57) ABSTRACT

Aqueous working fluid (WF) steam generation system including: pressure vessel containing heat exchanger; enclosed combustion air (CA) chamber; burner; another heat exchanger outside pressure vessel; and WF conduit. Heat exchanger includes first: enclosed WF chamber having WF input and output apertures (IOA); and enclosed CA passageway communicating with CAIOA and passing through enclosed WF chamber. Enclosed CA chamber includes second: enclosed WF chamber having WFIOA; and enclosed CA passageway communicating with CAIOA. Burner is connected to second CA input aperture. Another heat exchanger includes third: enclosed WF chamber having WFIOA; and enclosed CA passageway communicating with CAIOA. WF conduit connects third WF output aperture to second WF input aperture. Second WF output aperture is connected to first WF input aperture; and second CA output aperture is connected to first CA input aperture; and first CA output aperture is connected to third CA input aperture.

37 Claims, 12 Drawing Sheets

Related U.S. Application Data

(60) Provisional application No. 61/420,005, filed on Dec. 6, 2010.

(51) Int. Cl.

| | |
|---|---|
| ***F22B 31/08*** | (2006.01) |
| ***F22B 37/62*** | (2006.01) |
| ***F22B 9/12*** | (2006.01) |
| ***F22B 35/00*** | (2006.01) |
| ***F22B 37/46*** | (2006.01) |
| ***F28F 9/26*** | (2006.01) |
| ***F28D 7/00*** | (2006.01) |
| ***F28D 7/10*** | (2006.01) |
| ***F28D 21/00*** | (2006.01) |

(52) U.S. Cl.
CPC ..... *F22B 37/46* (2013.01); *F22B 37/62* (2013.01); *F28D 7/0041* (2013.01); *F28D 7/103* (2013.01); *F28D 7/106* (2013.01); *F28D 21/0017* (2013.01); *F28F 9/26* (2013.01)

(58) Field of Classification Search
USPC ..... 122/33, 49, 95.1, 44.1, 209.1, 214, 215, 122/216, 51, 52, 47, 211, 210, 406.4, 122/451 S
See application file for complete search history.

(56) References Cited

U.S. PATENT DOCUMENTS

| | | | | |
|---|---|---|---|---|
| 797,107 | A | 8/1905 | Haarmann | |
| 1,488,359 | A | 3/1924 | Lopez | |
| 3,392,711 | A | 7/1968 | Wolfersperger | |
| 3,793,994 | A | 2/1974 | Olsen | |
| 4,030,302 | A | 6/1977 | Mankouski | |
| 4,189,295 | A | 2/1980 | Ramon | |
| 4,207,840 | A * | 6/1980 | Dauvergne | F22B 1/167 122/31.1 |
| 4,470,359 | A | 9/1984 | Smith | |
| 4,493,637 | A | 1/1985 | Ganter | |
| 4,869,208 | A | 9/1989 | Adams | |
| 4,938,204 | A | 7/1990 | Adams | |
| 5,022,352 | A | 6/1991 | Osborne | |
| 5,271,215 | A | 12/1993 | Guillet | |
| 5,902,098 | A | 5/1999 | Park | |
| 5,968,320 | A | 10/1999 | Sprague | |
| 6,032,616 | A | 3/2000 | Jones | |
| 6,053,130 | A | 4/2000 | Shellenberger | |
| 6,394,042 | B1 | 5/2002 | West | |
| 6,508,645 | B1 | 1/2003 | George | |
| 6,585,785 | B1 | 7/2003 | Warren | |
| 9,121,602 | B2 | 9/2015 | Van Wyk | |
| 2001/0051321 | A1 | 12/2001 | La Fontaine | |
| 2002/0162320 | A1 | 11/2002 | Uchida | |
| 2008/0011245 | A1 | 1/2008 | Donnelly | |
| 2009/0101085 | A1 * | 4/2009 | Arensmeier | F23N 5/242 122/14.22 |
| 2009/0151653 | A1 | 6/2009 | Mullen | |
| 2011/0061609 | A1 | 3/2011 | Van Wyk | |

OTHER PUBLICATIONS

PCT International Search Report in US2010/049075, dated Nov. 5, 2010, 2 pages.
PCT Written Opinion of the International Search Authority in US2010/049075, dated Nov. 5, 2010, 7 pages.
Canadian Office Action dated May 13, 2013 for Canadian Patent Application No. 2,761,035.
"Wall" definition, downloaded on Mar. 18, 2015 from http://dictionary.reference.com/browse/wall, 3 pages.
"Triangle Tube Prestige Condensing Water Boiler Service Technician's Trouble Shooting Guide," May 11, 2009, 44pp.
"Triangle Tube Engineering Submittal Prestige Solo 110," Feb. 15, 2012, 2pp.
"Triangle Tube Prestige Solo 110 Water Boiler Installation and Maintenance Manual," May 29, 2012, 89pp.
"Triangle Tube Engineering Submittal Prestige Solo 299," Jul. 1, 2016, 2pp.
"Prestige Solo 60, 110, Excellence Service Parts Instructions," Feb. 25, 2014, 14pp.
"Triangle Tube Suggested Specifications Prestige Solo 175," Jan. 16, 2013, 5pp.
"Prestige User's Information Manual," Jan. 7, 2014, 36pp.
"Prestige Solo Condensing High Efficiency Gas Boiler," Oct. 24, 2013, 4pp.

* cited by examiner

AQUEOUS WORKING FLUID STEAM GENERATION SYSTEM

CROSS-REFERENCE TO RELATED APPLICATIONS

This application is a continuation-in-part of U.S. patent application Ser. No. 13/311,271 filed on Dec. 5, 2011 ("the '271 application"), and is a continuation-in-part of U.S. patent application Ser. No. 61/420,005 filed on Dec. 6, 2010 ("the '005 application"), the entireties of both of which are hereby incorporated herein by reference.

BACKGROUND OF THE INVENTION

1. Field of the Invention

The present invention relates to the field of aqueous working fluid steam generation systems that include a pressure vessel.

2. Background of the Invention

Numerous aqueous working fluid steam generation systems including pressure vessels have been developed. As examples, some of these aqueous working fluid steam generation systems may include a heat exchanger. Despite the existence of these aqueous working fluid steam generation systems, further improvements are still needed in aqueous working fluid steam generation systems that include a pressure vessel and a heat exchanger.

SUMMARY

In an example of an implementation, an aqueous working fluid steam generation system is provided that includes: a pressure vessel; an enclosed combustion air chamber; a burner; another heat exchanger; and a working fluid conduit. In the example of the aqueous working fluid steam generation system, the pressure vessel contains a heat exchanger. Further in the example of the aqueous working fluid steam generation system, the heat exchanger includes a first enclosed working fluid chamber having a first working fluid input aperture and having a first working fluid output aperture. In the example of the aqueous working fluid steam generation system, the heat exchanger further includes a first enclosed combustion air passageway communicating with a first combustion air input aperture and with a first combustion air output aperture, the first enclosed combustion air passageway passing through the first enclosed working fluid chamber. In the example of the aqueous working fluid steam generation system, the enclosed combustion air chamber includes a second enclosed working fluid chamber having a second working fluid input aperture and having a second working fluid output aperture. Further in the example of the aqueous working fluid steam generation system, the enclosed combustion air chamber also includes a second enclosed combustion air passageway communicating with a second combustion air input aperture and with a second combustion air output aperture. In the example of the aqueous working fluid steam generation system, the burner is connected to the second combustion air input aperture. Additionally in the example of the aqueous working fluid steam generation system, the another heat exchanger is outside of the pressure vessel. Further in the example of the aqueous working fluid steam generation system, the another heat exchanger includes a third enclosed working fluid chamber having a third working fluid input aperture and having a third working fluid output aperture. Additionally in the example of the aqueous working fluid steam generation system, the another heat exchanger further includes a third enclosed combustion air passageway communicating with a third combustion air input aperture and with a third combustion air output aperture. In the example of the aqueous working fluid steam generation system, the working fluid conduit connects the third working fluid output aperture to the second working fluid input aperture. Further in the example of the aqueous working fluid steam generation system: the second working fluid output aperture is connected to the first working fluid input aperture; and the second combustion air output aperture is connected to the first combustion air input aperture; and the first combustion air output aperture is connected to the third combustion air input aperture.

In some examples of the implementation of the aqueous working fluid steam generation system, the enclosed combustion air chamber may include an inner wall being spaced apart from an outer wall, and the second enclosed working fluid chamber may be an intervening space between the inner and outer walls of the enclosed combustion air chamber.

In further examples of the implementation of the aqueous working fluid steam generation system, the enclosed combustion air chamber may be contained by a working fluid jacket, and the working fluid jacket may form the second enclosed working fluid chamber.

In additional examples of the implementation of the aqueous working fluid steam generation system, the enclosed combustion air chamber may be contained by the pressure vessel.

In other examples of the implementation of the aqueous working fluid steam generation system, the first enclosed combustion air passageway of the heat exchanger may include a plurality of conduits each communicating with the first combustion air input aperture and with the first combustion air output aperture, each one of the plurality of the conduits of the first enclosed combustion air passageway passing through the first enclosed working fluid chamber.

In some examples of the implementation of the aqueous working fluid steam generation system, the third enclosed combustion air passageway of the another heat exchanger may include a plurality of conduits each communicating with the third combustion air input aperture and with the third combustion air output aperture, each one of the plurality of the conduits of the third enclosed combustion air passageway passing through the third enclosed working fluid chamber.

In further examples, the example of the implementation of the aqueous working fluid steam generation system may be configured for constraining an aqueous working fluid to follow a flow path: from an aqueous working fluid source into the third enclosed working fluid chamber; and from the third enclosed working fluid chamber into the working fluid conduit; and from the working fluid conduit into the second enclosed working fluid chamber; and from the second enclosed working fluid chamber into the first enclosed working fluid chamber.

In additional examples, the example of the implementation of the aqueous working fluid steam generation system may be configured for constraining an aqueous working fluid to follow a flow path: from an aqueous working fluid source into the third enclosed working fluid chamber; and from the third enclosed working fluid chamber into the working fluid conduit; and from the working fluid conduit into the second enclosed working fluid chamber; and from the second enclosed working fluid chamber into the first enclosed working fluid chamber; and from the first enclosed working fluid chamber passing through the first working fluid output aperture.

In other examples of the implementation of the aqueous working fluid steam generation system, the pressure vessel may include a valve connected to the first working fluid output aperture; and the valve may be configured for controlling a passing of the aqueous working fluid through the first working fluid output aperture.

In some examples of the implementation of the aqueous working fluid steam generation system, the valve may be configured for controlling the passing of the aqueous working fluid at an elevated pressure through the first working fluid output aperture.

In further examples of the implementation of the aqueous working fluid steam generation system, the valve may be configured for controlling the passing of the aqueous working fluid through the first working fluid output aperture as including aqueous working fluid steam.

In additional examples, the example of the implementation of the aqueous working fluid steam generation system may include another working fluid conduit connecting the first working fluid output aperture to the third working fluid input aperture, and the pressure vessel may include a valve connected to the first working fluid output aperture; and the valve may be configured for controlling a passing of the aqueous working fluid through the first working fluid output aperture; and the another working fluid conduit may be configured for controlling a passing of the aqueous working fluid from the first working fluid output aperture into the third enclosed working fluid chamber.

In other examples of the implementation of the aqueous working fluid steam generation system, the working fluid conduit may be configured for constraining the aqueous working fluid to follow the flow path into the second enclosed working fluid chamber before a passing of the aqueous working fluid through the first working fluid output aperture.

In some examples of the implementation of the aqueous working fluid steam generation system, the working fluid conduit may be contained by the pressure vessel.

In further examples of the implementation of the aqueous working fluid steam generation system, the working fluid conduit may pass through the first enclosed working fluid chamber.

In additional examples of the implementation of the aqueous working fluid steam generation system, the working fluid conduit may be outside of the first enclosed working fluid chamber.

In other examples of the implementation of the aqueous working fluid steam generation system, the working fluid conduit may include a fourth enclosed working fluid chamber being contained by the pressure vessel.

In some examples of the implementation of the aqueous working fluid steam generation system, the pressure vessel may include an inner wall being spaced apart from an outer wall, and the fourth enclosed working fluid chamber may be an intervening space between the inner and outer walls of the pressure vessel.

In further examples of the implementation of the aqueous working fluid steam generation system, the first enclosed working fluid chamber may be contained by the inner wall of the pressure vessel.

In additional examples of the implementation of the aqueous working fluid steam generation system, the working fluid conduit may be outside of the pressure vessel.

In other examples of the implementation of the aqueous working fluid steam generation system, the pressure vessel may be contained by a working fluid jacket that may form a fourth enclosed working fluid chamber; and the fourth enclosed working fluid chamber may include a fourth aqueous working fluid input aperture and a fourth aqueous working fluid output aperture; and the fourth aqueous working fluid input and output apertures may be connected to the working fluid conduit.

In some examples, the example of the implementation of the aqueous working fluid steam generation system may further include a working fluid pressure source being connected to the third working fluid input aperture.

In further examples of the implementation of the aqueous working fluid steam generation system, the working fluid pressure source may be configured for causing the aqueous working fluid to follow the flow path: from the aqueous working fluid source into the third enclosed working fluid chamber; and from the third enclosed working fluid chamber into the working fluid conduit; and from the working fluid conduit into the second enclosed working fluid chamber; and from the second enclosed working fluid chamber into the first enclosed working fluid chamber; and from the first enclosed working fluid chamber passing through the first working fluid output aperture.

In additional examples of the implementation of the aqueous working fluid steam generation system, the working fluid pressure source may include a fluid pump.

In other examples of the implementation of the aqueous working fluid steam generation system, the burner may be configured for causing combustion air to enter the second enclosed combustion air passageway.

In some examples, the example of the implementation of the aqueous working fluid steam generation system may be configured for constraining the combustion air to follow a flow path: from the burner into the second enclosed combustion air passageway; and from the second enclosed combustion air passageway into the first enclosed combustion air passageway; and from the first enclosed combustion air passageway into the third enclosed combustion air passageway.

In further examples, the example of the implementation of the aqueous working fluid steam generation system may be configured for constraining the combustion air to follow a flow path: from the burner into the second enclosed combustion air passageway; and from the second enclosed combustion air passageway into the first enclosed combustion air passageway; and from the first enclosed combustion air passageway into the third enclosed combustion air passageway; and from the third enclosed combustion air passageway passing through the third combustion air output aperture.

In additional examples, the example of the implementation of the aqueous working fluid steam generation system may further include a fan being connected to the second combustion air input aperture.

In other examples of the implementation of the aqueous working fluid steam generation system, the fan may be configured for causing the combustion air to follow the flow path: from the burner into the second enclosed combustion air passageway; and from the second enclosed combustion air passageway into the first enclosed combustion air passageway; and from the first enclosed combustion air passageway into the third enclosed combustion air passageway; and from the third enclosed combustion air passageway passing through the third combustion air output aperture.

In some examples, the example of the implementation of the aqueous working fluid steam generation system may further include a vacuum source being connected to the third combustion air output aperture.

In further examples of the implementation of the aqueous working fluid steam generation system, the vacuum source may be configured for causing the combustion air to follow the flow path: from the burner into the second enclosed combustion air passageway; and from the second enclosed combustion air passageway into the first enclosed combustion air passageway; and from the first enclosed combustion air passageway into the third enclosed combustion air passageway; and from the third enclosed combustion air passageway passing through the third combustion air output aperture.

In additional examples of the implementation of the aqueous working fluid steam generation system, the vacuum source may include a fan or an air vacuum pump.

In other examples, the example of the implementation of the aqueous working fluid steam generation system may be configured for constraining the combustion air to follow a flow path, and may be configured for constraining an aqueous working fluid to follow another flow path; and a portion of the flow path may be countercurrent to a portion of the another flow path; and the portion of the flow path of the combustion air may be from the second enclosed combustion air passageway to the third enclosed combustion air passageway; and the portion of the another flow path of the aqueous working fluid may be from the third enclosed working fluid chamber to the second enclosed working fluid chamber.

In some examples of the implementation of the aqueous working fluid steam generation system, the burner may be configured for causing combustion air to enter the second enclosed combustion air passageway; and the system may be configured for constraining the combustion air to follow a flow path and may be configured for constraining an aqueous working fluid to follow another flow path; and a portion of the flow path may be countercurrent to a portion of the another flow path; and the portion of the flow path of the combustion air may be from the second enclosed combustion air passageway to the first enclosed combustion air passageway to the third enclosed combustion air passageway; and the portion of the another flow path of the aqueous working fluid may be from the third enclosed working fluid chamber to the working fluid conduit to the second enclosed working fluid chamber.

Other systems, devices, processes, features and advantages of the invention will be or will become apparent to one with skill in the art upon examination of the following figures and detailed description. It is intended that all such additional systems, devices, processes, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
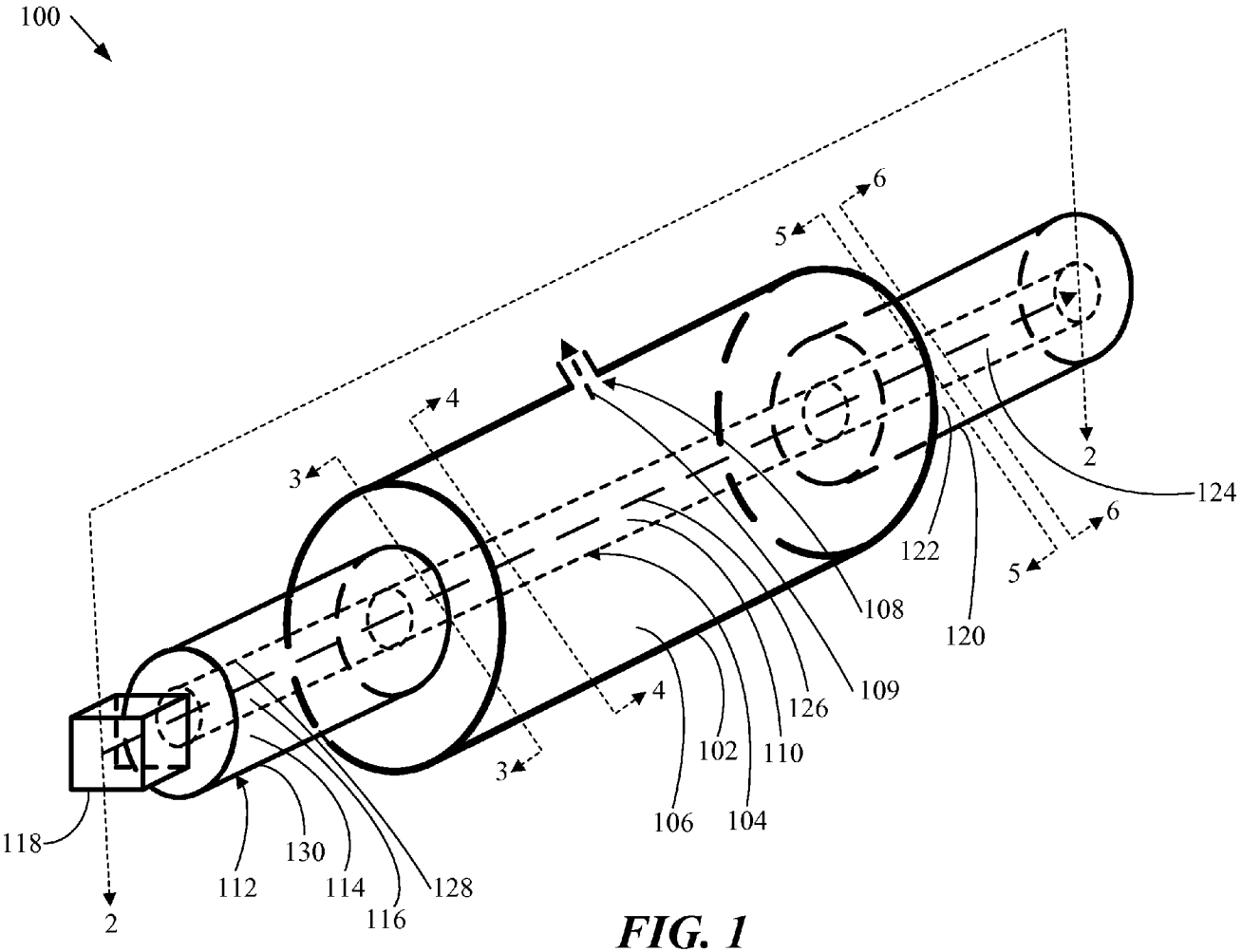
FIG. 1 is a perspective view showing an example [100] of an implementation of an aqueous working fluid steam generation system.

Various aqueous working fluid steam generation systems that include a pressure vessel and a heat exchanger have been designed. However, existing such aqueous working fluid steam generation systems often have demonstrably failed to provide efficient transfer of thermal energy, being generated by a burner, to the aqueous working fluid.

In an example, an aqueous working fluid (WF) steam generation system accordingly is provided herein that may include: a pressure vessel; an enclosed combustion air (CA) chamber; a burner; another heat exchanger; and a working fluid (WF) conduit. In the example of the aqueous working fluid (WF) steam generation system, the pressure vessel contains a heat exchanger. Further in the example of the aqueous working fluid (WF) steam generation system, the heat exchanger includes a first enclosed working fluid (WF) chamber having first working fluid (WF) input and output apertures (IOA). In the example of the aqueous working fluid (WF) steam generation system, the heat exchanger further includes a first enclosed combustion air (CA) passageway communicating with first combustion air (CA) input and output apertures (IOA), the first enclosed combustion air (CA) passageway passing through the first enclosed working fluid (WF) chamber. In the example of the aqueous working fluid (WF) steam generation system, the enclosed combustion air (CA) chamber includes a second enclosed working fluid (WF) chamber having second working fluid (WF) input and output apertures (IOA). Further in the example of the aqueous working fluid (WF) steam generation system, the enclosed combustion air (CA) chamber also includes a second enclosed combustion air (CA) passageway communicating with second combustion air (CA) input and output apertures (IOA). In the example of the aqueous working fluid (WF) steam generation system, the burner is connected to the second combustion air (CA) input aperture. Additionally in the example of the aqueous working fluid (WF) steam generation system, the another heat exchanger is outside of the pressure vessel. Further in the example of the aqueous working fluid (WF) steam generation system, the another heat exchanger includes a third enclosed working fluid (WF) chamber having third working fluid (WF) input and output apertures (IOA). Additionally in the example of the aqueous working fluid (WF) steam generation system, the another heat exchanger further includes a third enclosed combustion air (CA) passageway communicating with third combustion air (CA) input and output apertures (IOA). In the example of the aqueous working fluid (WF) steam generation system, the working fluid (WF) conduit connects the third working fluid (WF) output aperture to the second working fluid (WF) input aperture. Further in the example of the aqueous working fluid (WF) steam generation system: the second working fluid (WF) output aperture is connected to the first working fluid (WF) input aperture; and the second combustion air (CA) output aperture is connected to the first combustion air (CA) input aperture; and the first combustion air (CA) output aperture is connected to the third combustion air (CA) input aperture.

The following definitions of terms, being stated as applying "throughout this specification", are hereby deemed to be incorporated throughout the Summary, Brief Description of the Figures, Detailed Description, Claims, and Abstract.

Throughout this specification, the term "configure" means to set up for operation in a particular way.

Throughout this specification, the term "object" means a physical article or a physical device. Throughout this specification, the term "surface" means a boundary of an object.

Throughout this specification, the term "in contact with" means: that a first object, being "in contact with" a second object, is in either direct or indirect contact with the second object. Throughout this specification, the term "in indirect contact with" means: that the first object is not in direct contact with the second object, but instead that there are a plurality of objects including the first and second objects, and that each one of the plurality of objects is in direct contact with at least one other of the plurality of objects (e.g., the first and second objects are in a stack of layers or other objects and are separated by one or more intervening layers or other objects). Throughout this specification, the term "in direct contact with" means: that the first object, which is "in direct contact" with a second object, is touching the second object and there are no intervening objects between at least portions of both the first and second objects.

Throughout this specification, the term "upper" means a region of an object that is illustrated in a Figure herein as being relatively above another region of an object. Throughout this specification, the term "lower" means a region of an object that is illustrated in a Figure herein as being relatively below another region of an object. It is understood that the terms "upper", "above", "lower" and "below" are relative terms regarding objects as illustrated in the Figures; and that the objects illustrated in the Figures may be oriented in other directions.

Throughout this specification, the term "fluid" means a substance that cannot resist a shear force being applied to it; a fluid may include a liquid phase or a gaseous phase or both liquid and gaseous phases, and may further include a solid phase, for example a dispersed solid phase. Throughout this specification, the term "liquid" means a fluid forming a free surface; and the term "gas" means a fluid not forming a free surface. Throughout this specification, the term "working fluid" means a fluid being utilized for the transfer of heat, i.e. "thermal energy". Throughout this specification, the term "aqueous working fluid" means a working fluid that contains water and which may contain other substances. Throughout this specification, the term "steam" means water having been boiled into being in its gaseous phase. Throughout this specification, the term "aqueous working fluid steam" means an aqueous working fluid containing water, in which the water has been boiled into being in its gaseous phase. Throughout this specification, the term "aqueous working fluid source" means a source of a supply of an aqueous working fluid. Throughout this specification, the term "aqueous working fluid steam generation" means transferring thermal energy into an aqueous working fluid so that the water is boiled into being in its gaseous phase. Throughout this specification, the term "elevated pressure" means the state of an aqueous working fluid as being pressurized at a pressure being at least about thirty (30) pounds per square inch gauge (PSIG).

Throughout this specification, the terms "contained by" and "inside" mean being within a designated object or within designated surfaces of a designated object; the term "outside" means being external to a designated object or to designated surfaces of a designated object; and the term "containing" means having a designated object or fluid located inside. Throughout this specification, the term "chamber" means a cavity contained by an object. Throughout this specification, the term "inner wall being spaced apart from an outer wall" of a chamber defines an "inner chamber" being within an "outer chamber", wherein the inner wall defines a boundary of the inner chamber; and wherein the outer wall and the inner wall together define boundaries of an intervening space between them, being the outer chamber. Throughout this specification, an "inner wall" or an "outer wall" may have a single "side", being, as examples, a sphere or an ellipsoid; or may have a plurality of "sides", being, as examples, a rectangular prism, a cone, a capsule, or a cylinder.

Throughout this specification, the term "passageway" means a chamber that causes a fluid entering at one point on a surface of the object to be passed along the passageway and to flow through the object to another point on a surface of the object. Throughout this specification, it is understood that a passageway may, for example, include baffles configured for diverting a linear flow of a fluid so as to enhance uniformity of fluid flow inside the passageway. As an example, a passageway for an aqueous working fluid may include metal spirals being spaced apart within the passageway for creating a diversionary flow path. For example, elongated metal spirals having a transverse diameter of about a half-inch may be mutually spaced apart by distances of about four inches within a passageway. Further, for example, a passageway for combustion air may be rifled for creating a diversionary flow path. Throughout this specification, the term "flow path" means a plurality of passageways, collectively communicating through a corresponding plurality of objects, being linked together for causing a fluid that enters at one point on a surface of one of the plurality of the objects to pass along and flow through the passageways to another point on a surface of another one of the plurality of the objects. Throughout this specification, the term "countercurrent flow paths" means two flow paths, a one of the flow paths being in a direction that is opposite to another direction of the other one of the two flow paths. Throughout this specification, the term "constraining" means forcibly confining. For example, "constraining" a flow of an aqueous working fluid or of combustion air may include operating a control system configured for sensing and regulating the flow. As examples, sensing may include providing and operating sensors configured for detecting a rate or volume of a flow and for communicating sensor data to the control system. In further examples, regulating the flow of combustion air or of an aqueous working fluid may include providing the control system as having a microprocessor being configured for receiving and analyzing the sensor data for computing of control signals, and being configured for communicating the control signals to valves configured for regulating the flows. Additionally, for example, regulating the flows may include balancing a flow rate of the combustion air with a flow rate of the aqueous working fluid so as to generate a selected flow of aqueous working fluid steam. Throughout this specification, the term "pressure source" means a pressure-providing apparatus being suitable for forcing a fluid to flow through a passageway. Throughout this specification, the term "vacuum source" means a vacuum-providing apparatus being suitable for forcing a fluid to flow through a passageway. Throughout this specification, the term "fluid pump" means a positive pressure-providing pump apparatus or a vacuum-providing pump apparatus, being suitable for forcing a fluid to flow through a passageway. As an example, a "fluid pump" for an aqueous working fluid may include a pumping system or water tower delivering tap water from a municipal water supply. Further, for example, a "fluid pump" may be configured for preventing back-flow of an aqueous working fluid. Throughout this specification, the term "air vacuum pump" means a vacuum-providing pump apparatus being suitable for forcing combustion air to flow through a passageway. Throughout this specification, the term "fan" means a mechanical airflow-providing apparatus being suitable for forcing combustion air to flow through a passageway.

Throughout this specification, the term "aperture" means an opening at one point on an exterior surface of an object, that may form a portion of a passageway through the object and that may communicate with another aperture at another point on an exterior surface of the object. Throughout this specification, the term "input aperture" means an aperture being configured for facilitating a flow of a fluid into a chamber of an object. Throughout this specification, the term "output aperture" means an aperture being configured for facilitating a flow of a fluid out from a chamber of an object. Throughout this specification, the term "valve" means a device configured for controlling the passing of a fluid through a chamber; and which may, for example, be connected to an aperture. For example, a valve may be configured for preventing back-flow of an aqueous working fluid or of combustion air; and may be, for example, a one-way check valve. Throughout this specification, the term "working fluid jacket" means an object having or forming an enclosed fluid chamber with an input aperture and an output aperture, the object being located so that another object having another enclosed fluid chamber is contained by the object. Throughout this specification, the term "enclosed chamber" means a chamber of an object that may communicate with one or more apertures of the object and is otherwise closed. Throughout this specification, the term "enclosed passageway" means a passageway that may communicate with one or more apertures and is otherwise closed. Throughout this specification, the term "conduit" means a tube containing an enclosed passageway. Throughout this specification, the term "pressure vessel" means an object having an enclosed chamber that is suitably reinforced and structurally supported for containing an aqueous working fluid being maintained under an elevated pressure. Throughout this specification, the term "enclosed working fluid chamber" means an enclosed chamber for containing an aqueous working fluid. Throughout this specification, the term "burner" means a device that generates "combustion air" by oxidizing a fuel, for example a hydrocarbon fuel. Throughout this specification, the term "enclosed combustion air chamber" means an enclosed chamber for containing combustion air, and in which combustion air may be generated.

Throughout this specification, the term "heat exchanger" means a device having a passageway for an aqueous working fluid and having another passageway for combustion air, wherein the passageway and the another passageway are cooperatively arranged in the device for facilitating a transfer of thermal energy from the combustion air to the aqueous working fluid. In examples, a "heat exchanger" may have the passageway and the another passageway as being mutually arranged in single-pass or multiple-pass: parallel-flow; countercurrent; or cross-flow. As further examples, a "heat exchanger" may be of a type including: shell and tube; plate; plate and shell; plate fin; pillow plate; or spiral. In additional examples, a "heat exchanger" may include a plurality of passageways being mutually arranged as: straight; coiled; zig-zag; crisscrossed; spiral; circular; random; or in another arrangement. For example, a "heat exchanger" may be configured for a flow of combustion air through the another passageway being a flow through the passageway of a conduit, and may be configured for a flow of an aqueous working fluid through the passageway as being a flow around the conduit. As further examples, configuring a "heat exchanger" may include balancing a flow rate of combustion air through the passageway of the conduit with a rate of transfer of thermal energy from the passageway to the flow of the aqueous working fluid around the conduit. Additionally, for example, the configuring may include balancing: a selection of a plurality of conduits each having a passageway with a relatively small diameter as requiring relatively higher pressure to force combustion air through the passageways; with a selection of a plurality of conduits each having a passageway with a relatively large diameter as requiring relatively lower pressure to force combustion air through the passageways, while providing a lower efficiency in transferring thermal energy from the combustion air to the aqueous working fluid.

It is understood throughout this specification that numbering of the names of elements as being "first", "second" etcetera, is solely for purposes of clarity in referring to such elements in connection with various examples of aqueous working fluid steam generation systems. It is understood throughout this specification that an example [100], [700], [1300], [1900] of an aqueous working fluid steam generation system may include any combination of the features discussed in connection with the examples [100], [700], [1300], [1900] of an aqueous working fluid steam generation system.

Figure 2:
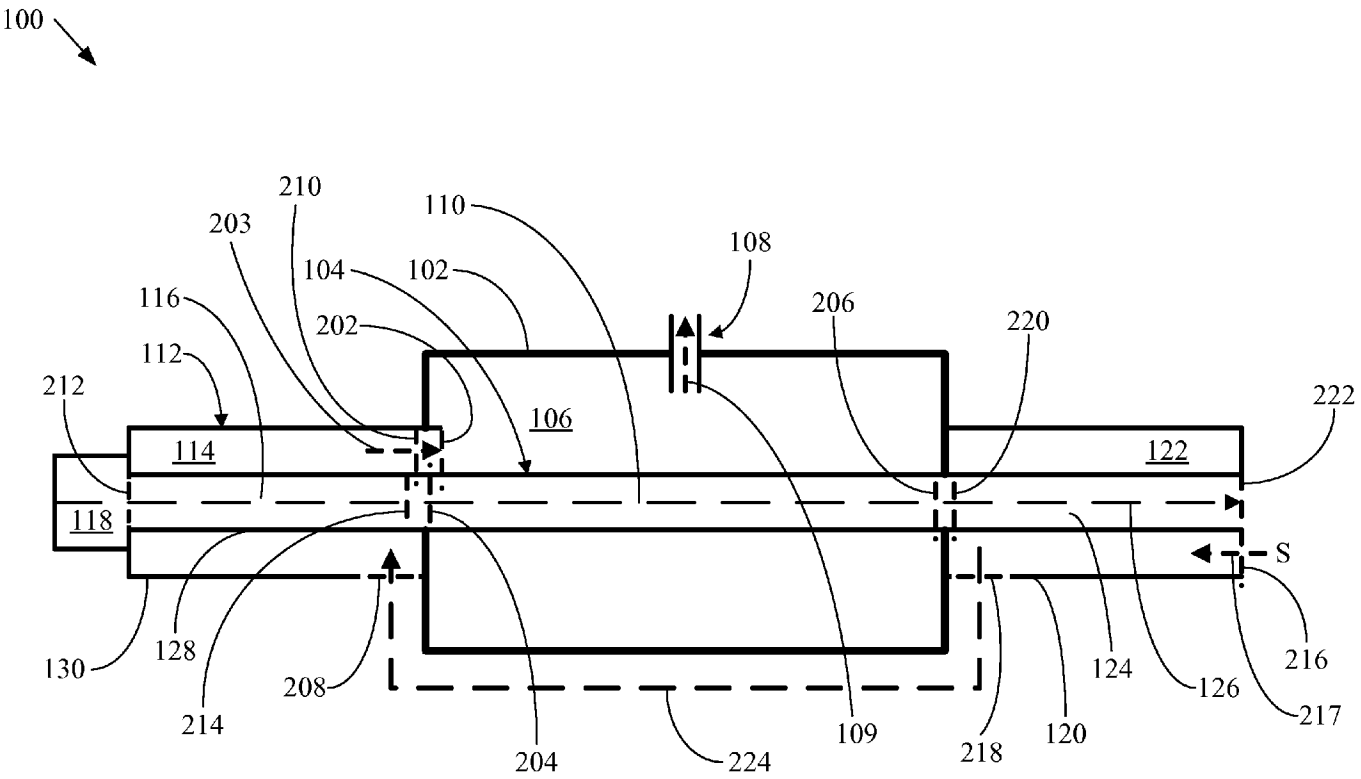
FIG. 2 is a cross-sectional view along the line 2-2 of the example [100] of the aqueous working fluid steam generation system shown in FIG. 1.
Figure 4:
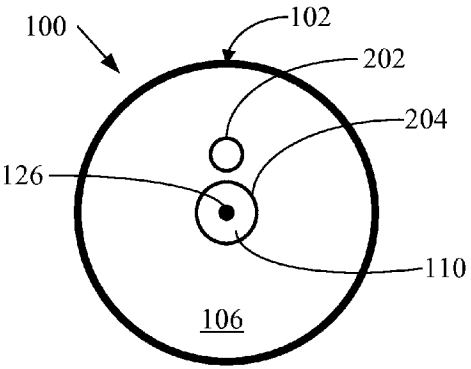
FIG. 4 is a cross-sectional view along the line 4-4 of the example [100] of the aqueous working fluid steam generation system shown in FIG. 1.
Figure 6:
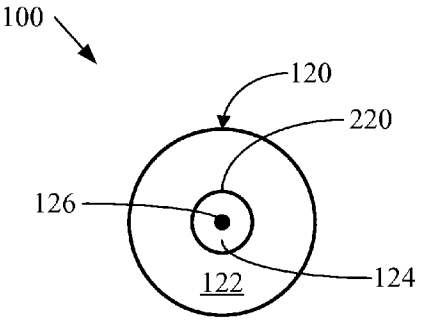
FIG. 6 is a cross-sectional view along the line 6-6 of the example [100] of the aqueous working fluid steam generation system shown in FIG. 1.
Figure 3:
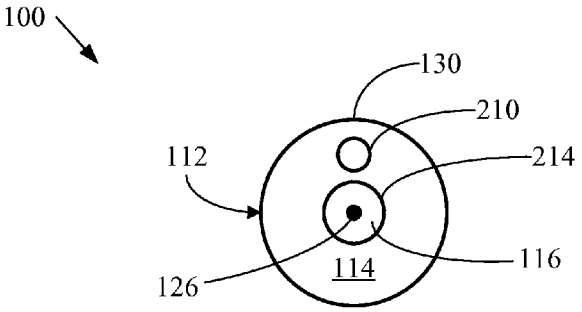
FIG. 3 is a cross-sectional view along the line 3-3 of the example [100] of the aqueous working fluid steam generation system shown in FIG. 1.
Figure 5:
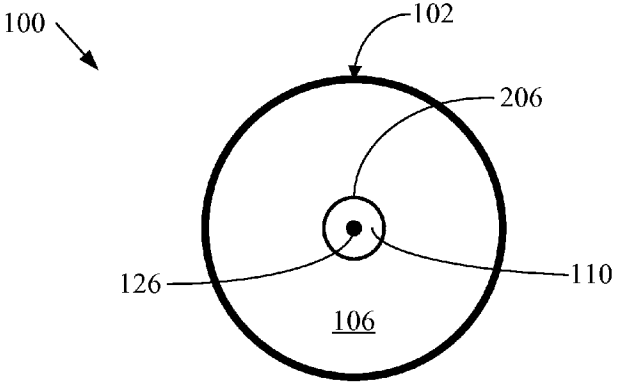
FIG. 5 is a cross-sectional view along the line 5-5 of the example [100] of the aqueous working fluid steam generation system shown in FIG. 1.

FIG. 1 is a perspective view showing an example [100] of an implementation of an aqueous working fluid steam generation system. FIG. 2 is a cross-sectional view along the line 2-2 of the example [100] of the aqueous working fluid steam generation system shown in FIG. 1. FIG. 3 is a cross-sectional view along the line 3-3 of the example [100] of the aqueous working fluid steam generation system shown in FIG. 1. FIG. 4 is a cross-sectional view along the line 4-4 of the example [100] of the aqueous working fluid steam generation system shown in FIG. 1. FIG. 5 is a cross-sectional view along the line 5-5 of the example [100] of the aqueous working fluid steam generation system shown in FIG. 1. FIG. 6 is a cross-sectional view along the line 6-6 of the example [100] of the aqueous working fluid steam generation system shown in FIG. 1. It is understood throughout this specification that an example [100] of an aqueous working fluid steam generation system may include any combination of the features that are discussed herein in connection with the examples [100], [700], [1300], [1900] of aqueous working fluid steam generation systems. Accordingly, the entireties of the discussions herein of the other examples [700], [1300], [1900] of aqueous working fluid steam generation systems are hereby incorporated in this discussion of the examples [100] of the aqueous working fluid steam generation systems. It is also understood that the examples [100] of aqueous working fluid steam generation systems may further include any combination of the features that are discussed in the '271 and '005 applications, the entireties of which applications accordingly are hereby incorporated into this discussion of the examples [100] of aqueous working fluid steam generation systems. As shown in FIGS. 1, 2, 3, 4, 5, and 6, the example [100] of the implementation of the aqueous working fluid steam generation system includes a pressure vessel [102] containing a heat exchanger [104], the heat exchanger [104] including a first enclosed working fluid chamber [106] having a first working fluid input aperture represented by a dashed line [202] and having a first working fluid output aperture [108]. In the example [100] of the aqueous working fluid steam generation system, the heat exchanger [104] further includes a first enclosed combustion air passageway [110] communicating with a first combustion air input aperture represented by a dashed line [204] and with a first combustion air output aperture represented by a dashed line [206], the first enclosed combustion air passageway [110] passing through the first enclosed working fluid chamber [106]. Additionally, the example [100] of the aqueous working fluid steam generation system includes an enclosed combustion air chamber [112] including a second enclosed working fluid chamber [114] having a second working fluid input aperture represented by a dashed line [208] and having a second working fluid output aperture represented by a dashed line [210]. In the example [100] of the aqueous working fluid steam generation system, the enclosed combustion air chamber [112] further includes a second enclosed combustion air passageway [116] communicating with a second combustion air input aperture represented by a dashed line [212] and with a second combustion air output aperture represented by a dashed line [214]. The example [100] of the aqueous working fluid steam generation system also includes a burner [118] being connected to the second combustion air input aperture [212]. Further, the example [100] of the aqueous working fluid steam generation system includes another heat exchanger [120] outside of the pressure vessel [102], the another heat exchanger [120] including a third enclosed working fluid chamber [122] having a third working fluid input aperture represented by a dashed line [216] and having a third working fluid output aperture represented by a dashed line [218]. In the example [100] of the aqueous working fluid steam generation system, the another heat exchanger [120] further includes a third enclosed combustion air passageway [124] communicating with a third combustion air input aperture represented by a dashed line [220] and with a third combustion air output aperture as represented by a dashed arrow [222]. In addition, the example [100] of the aqueous working fluid steam generation system includes a working fluid conduit being schematically represented by a dashed arrow [224], connecting the third working fluid output aperture [218] to the second working fluid input aperture [208]. In the example [100] of the aqueous working fluid steam generation system, the second working fluid output aperture [210] is connected to the first working fluid input aperture [202]; and the second combustion air output aperture [214] is connected to the first combustion air input aperture [204]; and the first combustion air output aperture [206] is connected to the third combustion air input aperture [220].

As examples, the enclosed combustion air chamber [112], the pressure vessel [102], and the another heat exchanger [120] may have generally cylindrical shapes, and the burner [118] may have a generally box-like shape; and in other examples (not shown), they each independently may have other shapes. In some examples [100] of the aqueous working fluid steam generation system, the enclosed combustion air chamber [112] may include an inner wall [128] being spaced apart from an outer wall [130]; and the second enclosed working fluid chamber [114] may be an intervening space between the inner wall [128] and the outer wall [130] of the enclosed combustion air chamber [112].

In further examples, the example [100] of the aqueous working fluid steam generation system may be configured for constraining an aqueous working fluid to follow a flow path: from an aqueous working fluid source being schematically represented by a letter "S", through the third working fluid input aperture [216] as represented by a dashed arrow [217], into the third enclosed working fluid chamber [122]; and from the third enclosed working fluid chamber [122] through the third working fluid output aperture [218] into the working fluid conduit [224]; and from the working fluid conduit [224] through the second working fluid input aperture [208], into the second enclosed working fluid chamber [114]; and from the second enclosed working fluid chamber [114] through the second working fluid output aperture [210] and the first working fluid input aperture [202] as represented by a dashed arrow [203], into the first enclosed working fluid chamber [106]. As further examples, the example [100] of the aqueous working fluid steam generation system may be configured for constraining an aqueous working fluid to further follow a flow path: from the aqueous working fluid source "S" into the third enclosed working fluid chamber [122]; and from the third enclosed working fluid chamber [122] into the working fluid conduit [224]; and from the working fluid conduit [224] into the second enclosed working fluid chamber [114]; and from the second enclosed working fluid chamber [114] into the first enclosed working fluid chamber [106]; and from the first enclosed working fluid chamber [106] passing through the first working fluid output aperture [108] as represented by a dashed arrow [109]. In additional examples [100] of the aqueous working fluid steam generation system, the working fluid conduit [224] may be configured for constraining the aqueous working fluid to follow the flow path into the second enclosed working fluid chamber [114] before a passing of the aqueous working fluid through the first working fluid output aperture [108]. For example, configuring the example [100] of the aqueous working fluid steam generation system for constraining the aqueous working fluid to follow the flow path may include sequentially connecting together the third working fluid input aperture [216], the third enclosed working fluid chamber [122], the working fluid conduit [224], the second enclosed working fluid chamber [114], the first enclosed working fluid chamber [106], and the first working fluid output aperture [108]. In an example of operation of the example [100] of the aqueous working fluid steam generation system, a lower portion of the first enclosed working fluid chamber [106] may be partially filled with an aqueous working fluid so as to keep the heat exchanger [104] immersed in the aqueous working fluid, while leaving an upper portion of the first enclosed working fluid chamber [106] above the heat exchanger [104] as being available for formation of steam. In an example, the working fluid conduit [224] may be outside of the pressure vessel [102].

In some examples [100] of the aqueous working fluid steam generation system, the burner [118] may be configured for causing combustion air to enter the second enclosed combustion air passageway [116]. For example, the burner [118] may be connected to the second enclosed combustion air passageway [116]. In further examples, the example [100] of the aqueous working fluid steam generation system may be configured for constraining the combustion air to follow a flow path being schematically represented by a dashed arrow [126]: from the burner [118] through the second combustion air input aperture [212] into the second enclosed combustion air passageway [116]; and from the second enclosed combustion air passageway [116] through the second combustion air output aperture [214] and the first combustion air input aperture [204] into the first enclosed combustion air passageway [110]; and from the first enclosed combustion air passageway [110] through the first combustion air output aperture [206] and the third combustion air input aperture [220] into the third enclosed combustion air passageway [124]. As additional examples, the example [100] of the aqueous working fluid steam generation system may be configured for constraining the combustion air to further follow a flow path being schematically represented by the dashed arrow [126]: from the burner [118] into the second enclosed combustion air passageway [116]; and from the second enclosed combustion air passageway [116] into the first enclosed combustion air passageway [110]; and from the first enclosed combustion air passageway [110] into the third enclosed combustion air passageway [124]; and from the third enclosed combustion air passageway [124] passing through the third combustion air output aperture [222].

As other examples, the example [100] of the aqueous working fluid steam generation system may be configured for constraining the combustion air to follow the flow path [126], and the system may be configured for constraining the aqueous working fluid to follow another flow path including the working fluid conduit [224]. Further in these other examples [100] of the aqueous working fluid steam generation system, a portion of the flow path [126], being from the second enclosed combustion air passageway [116] to the third enclosed combustion air passageway [124], may be countercurrent to a portion of the another flow path, being through the working fluid conduit [224] from the third enclosed working fluid chamber [122] to the second enclosed working fluid chamber [114]. In examples of the example [100] of the aqueous working fluid steam generation system, average temperatures of combustion air may gradually decrease along the flow path [126] from the burner [118] to the second enclosed combustion air passageway [116] to the first enclosed combustion air passageway [110] to the third enclosed combustion air passageway [124]. As further examples of the example [100] of the aqueous working fluid steam generation system, thermal energy remaining in the combustion air while passing through the third enclosed combustion air passageway [124] may be transferred into the aqueous working fluid while passing through the third enclosed working fluid chamber [122]; and then further thermal energy in the combustion air while passing through the second enclosed combustion air passageway [116] may be transferred into the aqueous working fluid while passing through the second enclosed working fluid chamber [114]; and then additional thermal energy in the combustion air while passing through the first enclosed combustion air passageway [110] may be transferred into the aqueous working fluid while passing through the first enclosed working fluid chamber [106].

Figure 7:
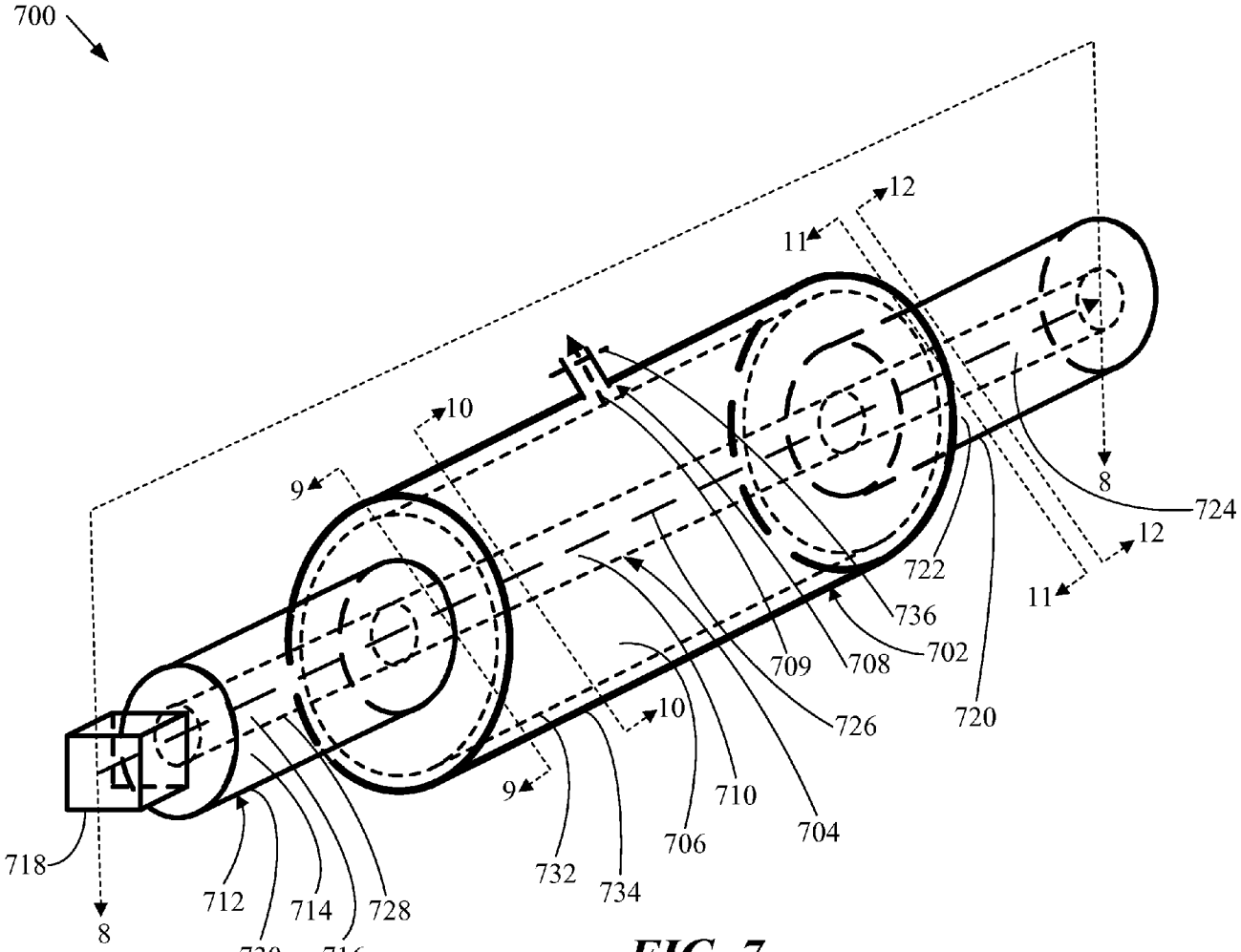
FIG. 7 is a perspective view showing another example [700] of an implementation of an aqueous working fluid steam generation system.
Figure 8:
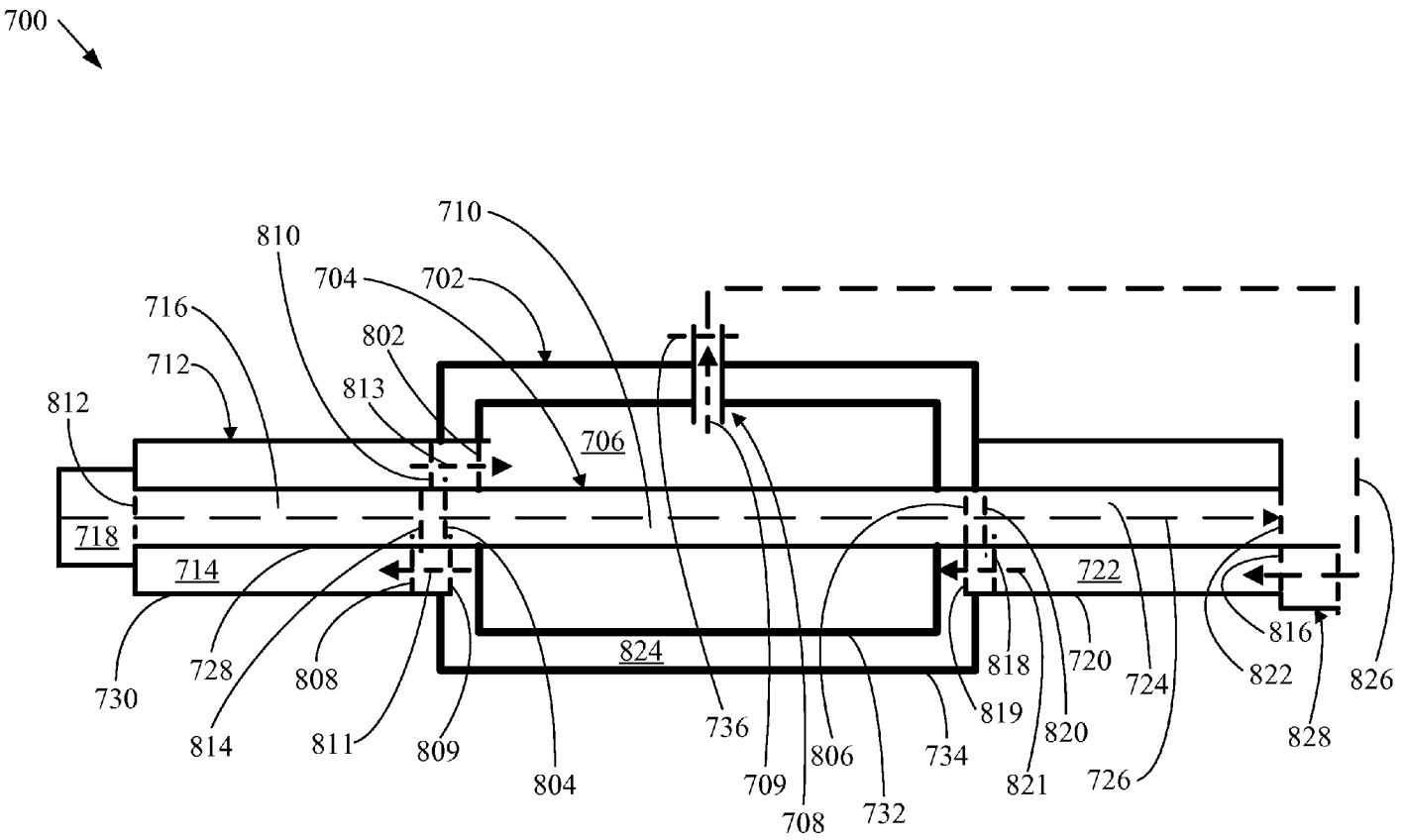
FIG. 8 is a cross-sectional view along the line 8-8 of the example [700] of the aqueous working fluid steam generation system shown in FIG. 7.
Figure 10:
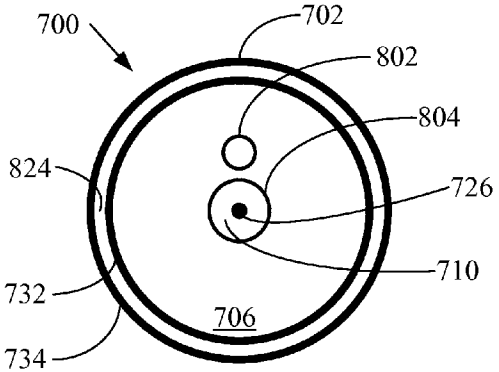
FIG. 10 is a cross-sectional view along the line 10-10 of the example [700] of the aqueous working fluid steam generation system shown in FIG. 7.
Figure 12:
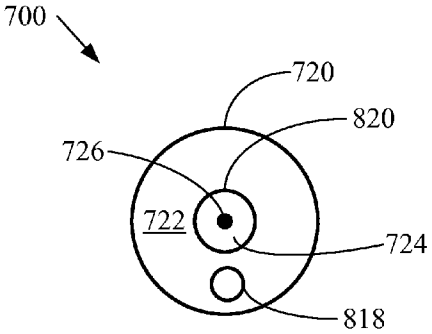
FIG. 12 is a cross-sectional view along the line 12-12 of the example [700] of the aqueous working fluid steam generation system shown in FIG. 7.
Figure 9:
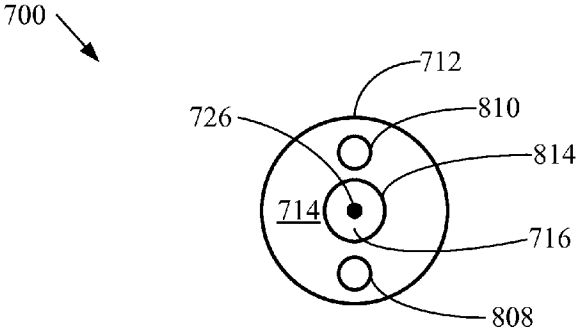
FIG. 9 is a cross-sectional view along the line 9-9 of the example [700] of the aqueous working fluid steam generation system shown in FIG. 7.
Figure 11:
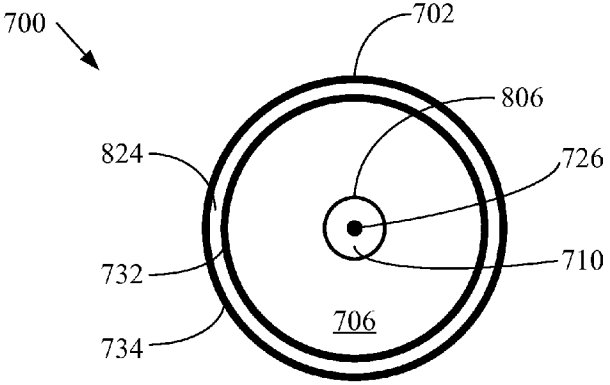
FIG. 11 is a cross-sectional view along the line 11-11 of the example [700] of the aqueous working fluid steam generation system shown in FIG. 7.

FIG. 7 is a perspective view showing another example [700] of an implementation of an aqueous working fluid steam generation system. FIG. 8 is a cross-sectional view along the line 8-8 of the example [700] of the aqueous working fluid steam generation system shown in FIG. 7. FIG. 9 is a cross-sectional view along the line 9-9 of the example [700] of the aqueous working fluid steam generation system shown in FIG. 7. FIG. 10 is a cross-sectional view along the line 10-10 of the example [700] of the aqueous working fluid steam generation system shown in FIG. 7. FIG. 11 is a cross-sectional view along the line 11-11 of the example [700] of the aqueous working fluid steam generation system shown in FIG. 7. FIG. 12 is a cross-sectional view along the line 12-12 of the example [700] of the aqueous working fluid steam generation system shown in FIG. 7. It is understood throughout this specification that an example [700] of an aqueous working fluid steam generation system may include any combination of the features that are discussed herein in connection with the examples [100], [700], [1300], [1900] of aqueous working fluid steam generation systems. Accordingly, the entireties of the discussions herein of the other examples [100], [1300], [1900] of aqueous working fluid steam generation systems are hereby incorporated in this discussion of the examples [700] of the aqueous working fluid steam generation systems. It is also understood that the examples [700] of aqueous working fluid steam generation systems may further include any combination of the features that are discussed in the '271 and '005 applications, the entireties of which applications accordingly are hereby incorporated into this discussion of the examples [700] of aqueous working fluid steam generation systems. As shown in FIGS. 7, 8, 9, 10, 11, and 12, the example [700] of the implementation of the aqueous working fluid steam generation system includes a pressure vessel [702] containing a heat exchanger [704], the heat exchanger [704] including a first enclosed working fluid chamber [706] having a first working fluid input aperture represented by a dashed line [802] and having a first working fluid output aperture [708]. In the example [700] of the aqueous working fluid steam generation system, the heat exchanger [704] further includes a first enclosed combustion air passageway [710] communicating with a first combustion air input aperture represented by a dashed line [804] and with a first combustion air output aperture represented by a dashed line [806], the first enclosed combustion air passageway [710] passing through the first enclosed working fluid chamber [706]. Additionally, the example [700] of the aqueous working fluid steam generation system includes an enclosed combustion air chamber [712] including a second enclosed working fluid chamber [714] having a second working fluid input aperture represented by a dashed line [808] and having a second working fluid output aperture represented by a dashed line [810]. In the example [700] of the aqueous working fluid steam generation system, the enclosed combustion air chamber [712] further includes a second enclosed combustion air passageway [716] communicating with a second combustion air input aperture represented by a dashed line [812] and with a second combustion air output aperture represented by a dashed line [814]. The example [700] of the aqueous working fluid steam generation system also includes a burner [718] being connected to the second combustion air input aperture [812]. Further, the example [700] of the aqueous working fluid steam generation system includes another heat exchanger [720] outside of the pressure vessel [702], the another heat exchanger [720] including a third enclosed working fluid chamber [722] having a third working fluid input aperture represented by a dashed line [816] and having a third working fluid output aperture represented by a dashed line [818]. In the example [700] of the aqueous working fluid steam generation system, the another heat exchanger [720] further includes a third enclosed combustion air passageway [724] communicating with a third combustion air input aperture represented by a dashed line [820] and with a third combustion air output aperture represented by a dashed line [822]. In addition, the example [700] of the aqueous working fluid steam generation system includes a working fluid conduit [824], connecting the third working fluid output aperture [818] to the second working fluid input aperture [808]. In some examples [700] of the aqueous working fluid steam generation system, the working fluid conduit [824] may include another working fluid input aperture represented by a dashed line [819], and may include another working fluid output aperture represented by a dashed line [809]. Further, for example, the another working fluid input aperture [819] may be configured for controlling a passing of the aqueous working fluid into the working fluid conduit [824]; and the another working fluid output aperture [809] may be configured for controlling a passing of the aqueous working fluid out from the working fluid conduit [824] and through the second working fluid input aperture [808] into the second enclosed working fluid chamber [714] of the example [700] of the aqueous working fluid steam generation system. In the example [700] of the aqueous working fluid steam generation system, the second working fluid output aperture [810] is connected to the first working fluid input aperture [802]; and the second combustion air output aperture [814] is connected to the first combustion air input aperture [804]; and the first combustion air output aperture [806] is connected to the third combustion air input aperture [820].

In an example of operation of the example [700] of the aqueous working fluid steam generation system, for example, a lower portion of the first enclosed working fluid chamber [706] may be partially filled with an aqueous working fluid so as to keep the heat exchanger [704] immersed in the aqueous working fluid, while leaving an upper portion of the first enclosed working fluid chamber [706] above the heat exchanger [704] available for formation of steam. As examples, the enclosed combustion air chamber [712], the pressure vessel [702], and the another heat exchanger [720] may have generally cylindrical shapes, and the burner [718] may have a generally box-like shape; and in other examples (not shown), they each independently may have other shapes. In some examples [700] of the aqueous working fluid steam generation system, the enclosed combustion air chamber [712] may include an inner wall [728] being spaced apart from an outer wall [730]; and the second enclosed working fluid chamber [714] may be an intervening space between the inner wall [728] and the outer wall [730] of the enclosed combustion air chamber [712].

In further examples [700] of the aqueous working fluid steam generation system, the working fluid conduit [824] may be contained by the pressure vessel [702]. Further, for example, the working fluid conduit [824] of the example [700] of the aqueous working fluid steam generation system may be outside of the first enclosed working fluid chamber [706]. Additionally, in the example [700] of the aqueous working fluid steam generation system, the working fluid conduit [824] may include, or may be, a fourth enclosed working fluid chamber [824] being contained by the pressure vessel [702]. In further examples [700] of the aqueous working fluid steam generation system, the pressure vessel [702] may include an inner wall [732] being spaced apart from an outer wall [734]; and the fourth enclosed working fluid chamber [824] may be an intervening space between the inner wall [732] and the outer wall [734] of the pressure vessel [702]. In some examples [700] of the aqueous working fluid steam generation system, the first enclosed working fluid chamber [706] may be contained by the inner wall [732] of the pressure vessel [702].

In additional examples of the example [700] of the aqueous working fluid steam generation system, the pressure vessel [702] may include a valve represented by a dashed line [736] connected to the first working fluid output aperture [708]; and the valve [736] may be configured for controlling a passing of the aqueous working fluid through the first working fluid output aperture [708]. As further examples [700] of the aqueous working fluid steam generation system, the valve [736] may be configured for controlling the passing of the aqueous working fluid at an elevated pressure through the first working fluid output aperture [708]. Further, for example, the valve [736] may be or may include a pressure relief valve configured for initiating the passing of the aqueous working fluid through the first working fluid output aperture [708] when the elevated pressure reaches a pre-set limit. In another example [700] of the aqueous working fluid steam generation system, the valve [736] may be configured for controlling the passing of the aqueous working fluid through the first working fluid output aperture [708] as including aqueous working fluid steam.

In other examples, the example [700] of the aqueous working fluid steam generation system may include another working fluid conduit being schematically represented by a dashed arrow [826]; and the another working fluid conduit [826] may connect the first working fluid output aperture [708] to the third working fluid input aperture [816]. Also in those other examples [700] of the aqueous working fluid steam generation system, the pressure vessel [702] may include the valve [736], being connected to the first working fluid output aperture [708]. Further in those other examples [700] of the aqueous working fluid steam generation system, the valve [736] may be configured for controlling a passing of the aqueous working fluid through the first working fluid output aperture [708]. Additionally in those other examples [700] of the aqueous working fluid steam generation system, the another working fluid conduit [826] may be configured for controlling a passing of the aqueous working fluid from the first working fluid output aperture [708] into the third enclosed working fluid chamber [722].

In further examples, the example [700] of the aqueous working fluid steam generation system may include a working fluid pressure source [828] being connected to the third working fluid input aperture [816]. In the further examples of the example [700] of the aqueous working fluid steam generation system, the working fluid pressure source [828] may be configured for causing the aqueous working fluid to follow a flow path: from the another working fluid conduit [826] through the third working fluid input aperture [816], into the third enclosed working fluid chamber [722]; and from the third enclosed working fluid chamber [722] through the third working fluid output aperture [818] and the another working fluid input aperture [819] as represented by a dashed arrow [821], into the working fluid conduit [824]; and from the working fluid conduit [824] through the another working fluid output aperture [809] and the second working fluid input aperture [808] as represented by a dashed arrow [811], into the second enclosed working fluid chamber [714]; and from the second enclosed working fluid chamber [714] through the second working fluid output aperture [810] and the first working fluid input aperture [802] as represented by a dashed arrow [813], into the first enclosed working fluid chamber [706]; and from the first enclosed working fluid chamber [706] passing through the first working fluid output aperture [708] as represented by a dashed arrow [709]. Also in the further examples of the example [700] of the aqueous working fluid steam generation system, the working fluid pressure source [828] may be or include a fluid pump. Alternatively in the further examples of the example [700] of the aqueous working fluid steam generation system, the another working fluid conduit [826] may be omitted, and the working fluid pressure source [828] may be configured for causing the aqueous working fluid to follow the flow path being modified as including in part: from an aqueous working fluid source S (not shown) through the third working fluid input aperture [816], into the third enclosed working fluid chamber [722] in the same manner as shown in FIG. 2 and discussed earlier in connection with the example [100] of the aqueous working fluid steam generation system.

In further examples, the example [700] of the aqueous working fluid steam generation system may be configured for constraining an aqueous working fluid to follow a flow path: from the another working fluid conduit [826] into the third enclosed working fluid chamber [722]; and from the third enclosed working fluid chamber [722] into the working fluid conduit [824]; and from the working fluid conduit [824] into the second enclosed working fluid chamber [714]; and from the second enclosed working fluid chamber [714] into the first enclosed working fluid chamber [706]. In additional examples, the example [700] of the aqueous working fluid steam generation system may be configured for constraining an aqueous working fluid to follow a flow path: from the another working fluid conduit [826] into the third enclosed working fluid chamber [722]; and from the third enclosed working fluid chamber [722] into the working fluid conduit [824]; and from the working fluid conduit [824] into the second enclosed working fluid chamber [714]; and from the second enclosed working fluid chamber [714] into the first enclosed working fluid chamber [706]; and from the first enclosed working fluid chamber [706] passing through the first working fluid output aperture [708]. In additional examples [700] of the aqueous working fluid steam generation system, the working fluid conduit [824] may be configured for constraining the aqueous working fluid to follow the flow path into the second enclosed working fluid chamber [714] before a passing of the aqueous working fluid through the first working fluid output aperture [708]. For example, configuring the example [700] of the aqueous working fluid steam generation system for constraining the aqueous working fluid to follow the flow path may include sequentially connecting together the third enclosed working fluid chamber [722], the working fluid conduit [824], the second enclosed working fluid chamber [714], the first enclosed working fluid chamber [706], and the first working fluid output aperture [708].

In some examples [700] of the aqueous working fluid steam generation system, the burner [718] may be configured for causing combustion air to enter the second enclosed combustion air passageway [716]. For example, the burner [718] may be connected to the second enclosed combustion air passageway [716]. In further examples, the example [700] of the aqueous working fluid steam generation system may be configured for constraining the combustion air to follow a flow path being schematically represented by a dashed arrow [726]: from the burner [718] through the second combustion air input aperture [812] into the second enclosed combustion air passageway [716]; and from the second enclosed combustion air passageway [716] through the second combustion air output aperture [814] and the first combustion air input aperture [804] into the first enclosed combustion air passageway [710]; and from the first enclosed combustion air passageway [710] through the first combustion air output aperture [806] and the third combustion air input aperture [820] into the third enclosed combustion air passageway [724]. As additional examples, the example [700] of the aqueous working fluid steam generation system may be configured for constraining the combustion air to further follow the flow path [726]: from the burner [718] into the second enclosed combustion air passageway [716]; and from the second enclosed combustion air passageway [716] into the first enclosed combustion air passageway [710]; and from the first enclosed combustion air passageway [710] into the third enclosed combustion air passageway [724]; and from the third enclosed combustion air passageway [724] passing through the third combustion air output aperture [822].

As other examples, the example [700] of the aqueous working fluid steam generation system may be configured for constraining the combustion air to follow the flow path

[726], and the system may be configured for constraining the aqueous working fluid to follow another flow path including the working fluid conduit [824]. Further in these other examples [700] of the aqueous working fluid steam generation system, a portion of the flow path [726] being from the second enclosed combustion air passageway [716] to the third enclosed combustion air passageway [724] may be countercurrent to a portion of the another flow path being through the working fluid conduit [824] from the third enclosed working fluid chamber [722] to the second enclosed working fluid chamber [714]. Additionally in these other examples [700] of the aqueous working fluid steam generation system, the burner [718] may be configured for causing combustion air to enter the second enclosed combustion air passageway [716]. Also in these other examples [700], the aqueous working fluid steam generation system may be configured for constraining the combustion air to follow a flow path and for constraining an aqueous working fluid to follow another flow path; and a portion of the flow path of the combustion air, being from the second enclosed combustion air passageway [716] to the first enclosed combustion air passageway [710] to the third enclosed combustion air passageway [724], may be countercurrent to a portion of the another flow path of the aqueous working fluid from the third enclosed working fluid chamber [722] to the working fluid conduit [824] to the second enclosed working fluid chamber [714]. In examples of the example [700] of the aqueous working fluid steam generation system, average temperatures of combustion air may gradually decrease along the flow path [726] from the burner [718] to the second enclosed combustion air passageway [716] to the first enclosed combustion air passageway [710] to the third enclosed combustion air passageway [724]. As further examples of the example [700] of the aqueous working fluid steam generation system, thermal energy remaining in the combustion air while passing through the third enclosed combustion air passageway [724] may be transferred into the aqueous working fluid while passing through the third enclosed working fluid chamber [722]; and then further thermal energy in the combustion air while passing through the second enclosed combustion air passageway [716] may be transferred into the aqueous working fluid while passing through the second enclosed working fluid chamber [714]; and then additional thermal energy in the combustion air while passing through the first enclosed combustion air passageway [710] may be transferred into the aqueous working fluid while passing through the first enclosed working fluid chamber [706].

Figure 13:
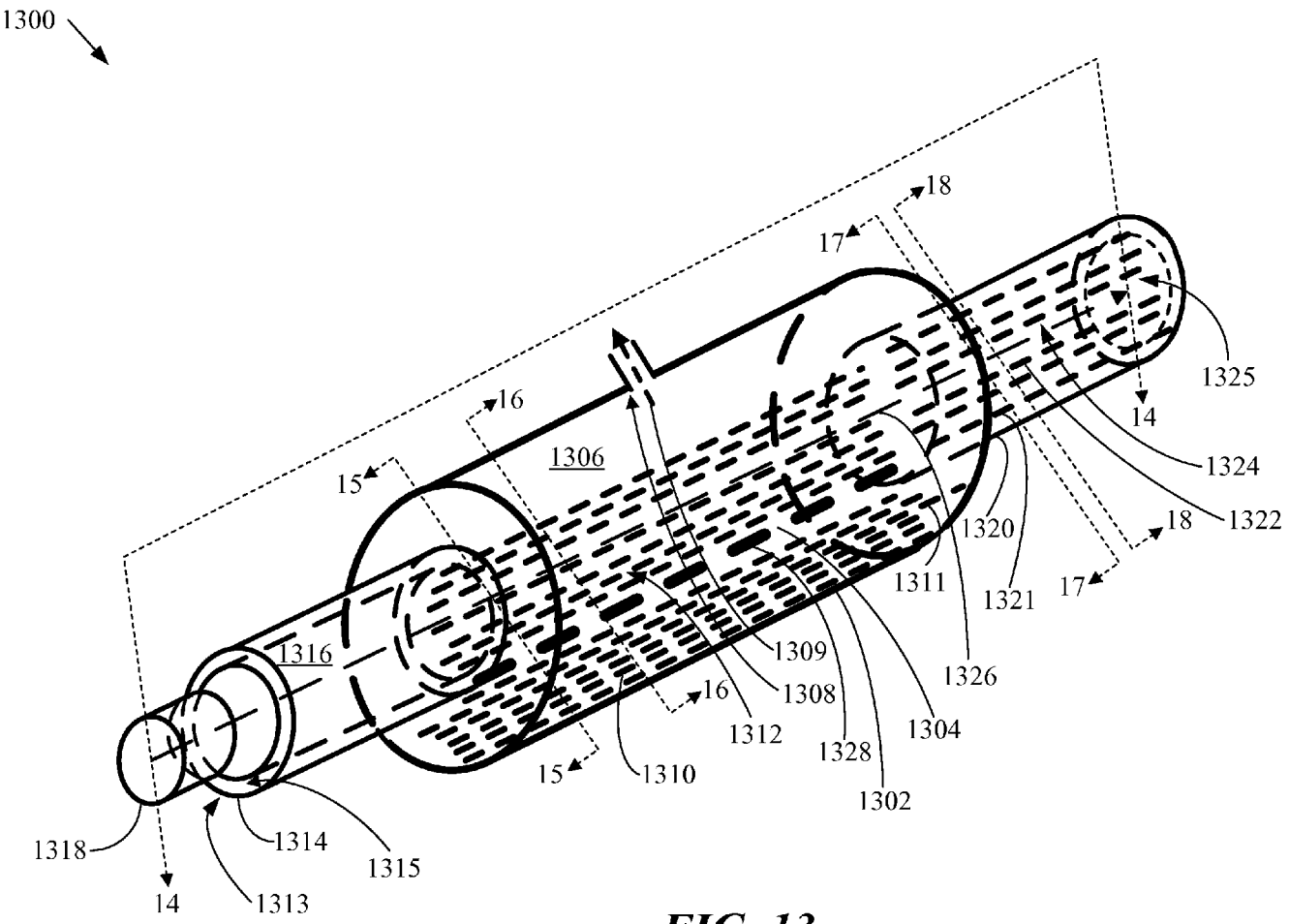
FIG. 13 is a perspective view showing a further example [1300] of an implementation of an aqueous working fluid steam generation system.
Figure 14:
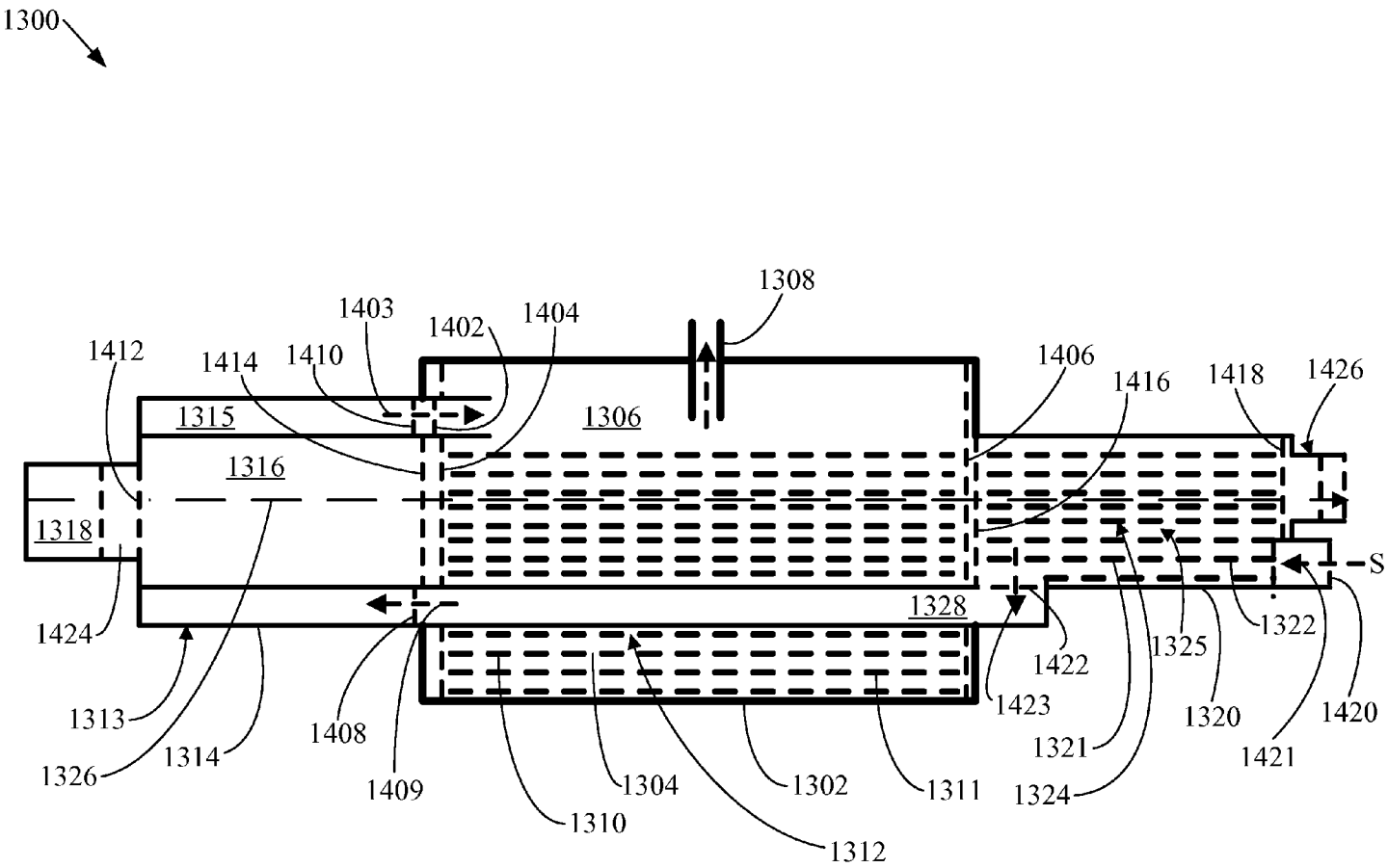
FIG. 14 is a cross-sectional view along the line 14-14 of the example [1300] of the aqueous working fluid steam generation system shown in FIG. 13.
Figure 15:
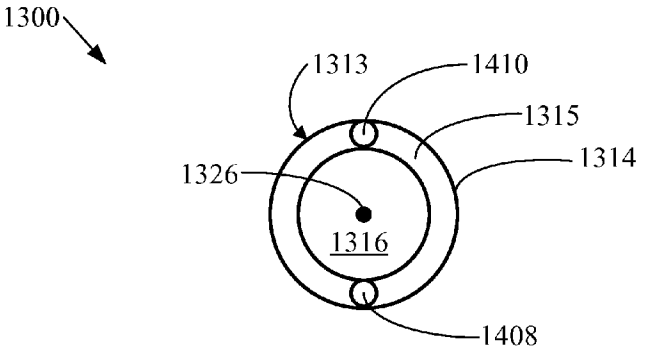
FIG. 15 is a cross-sectional view along the line 15-15 of the example [1300] of the aqueous working fluid steam generation system shown in FIG. 13.
Figure 16:
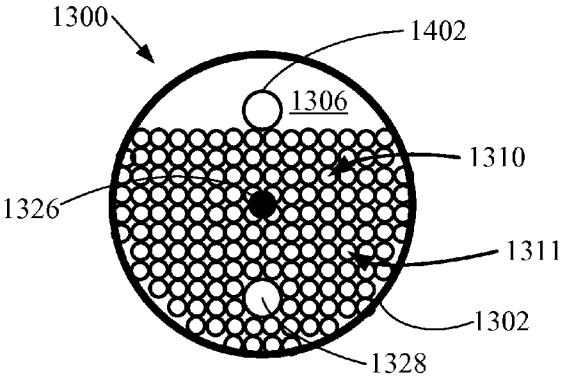
FIG. 16 is a cross-sectional view along the line 16-16 of the example [1300] of the aqueous working fluid steam generation system shown in FIG. 13.
Figure 17:
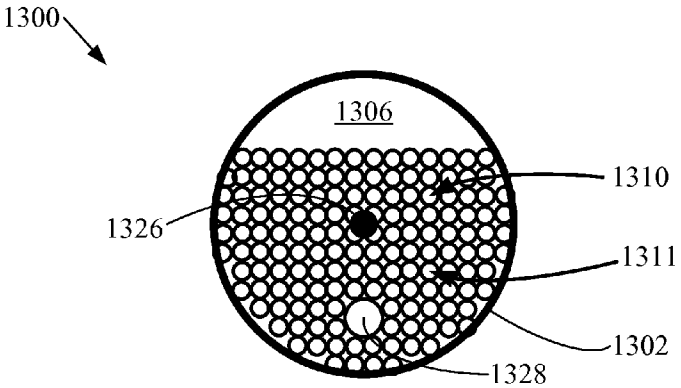
FIG. 17 is a cross-sectional view along the line 17-17 of the example [1300] of the aqueous working fluid steam generation system shown in FIG. 13.
Figure 18:
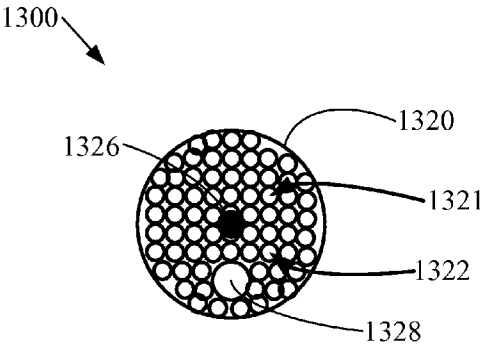
FIG. 18 is a cross-sectional view along the line 18-18 of the example [1300] of the aqueous working fluid steam generation system shown in FIG. 13.

FIG. 13 is a perspective view showing a further example [1300] of an implementation of an aqueous working fluid steam generation system. FIG. 14 is a cross-sectional view along the line 14-14 of the example [1300] of the aqueous working fluid steam generation system shown in FIG. 13. FIG. 15 is a cross-sectional view along the line 15-15 of the example [1300] of the aqueous working fluid steam generation system shown in FIG. 13. FIG. 16 is a cross-sectional view along the line 16-16 of the example [1300] of the aqueous working fluid steam generation system shown in FIG. 13. FIG. 17 is a cross-sectional view along the line 17-17 of the example [1300] of the aqueous working fluid steam generation system shown in FIG. 13. FIG. 18 is a cross-sectional view along the line 18-18 of the example [1300] of the aqueous working fluid steam generation system shown in FIG. 13. It is understood throughout this specification that an example [1300] of an aqueous working fluid steam generation system may include any combination of the features that are discussed herein in connection with the examples [100], [700], [1300], [1900] of aqueous working fluid steam generation systems. Accordingly, the entireties of the discussions herein of the other examples [100], [700], [1900] of aqueous working fluid steam generation systems are hereby incorporated in this discussion of the examples [1300] of the aqueous working fluid steam generation systems. It is also understood that the examples [1300] of aqueous working fluid steam generation systems may further include any combination of the features that are discussed in the '271 and '005 applications, the entireties of which applications accordingly are hereby incorporated into this discussion of the examples [1300] of aqueous working fluid steam generation systems. As shown in FIGS. 13, 14, 15, 16, 17, and 18, the example [1300] of the implementation of the aqueous working fluid steam generation system includes a pressure vessel [1302] containing a heat exchanger [1304], the heat exchanger [1304] including a first enclosed working fluid chamber [1306] having a first working fluid input aperture being represented by a dashed line [1402] and having a first working fluid output aperture [1308]. In the example [1300] of the aqueous working fluid steam generation system, the heat exchanger [1304] may further include a plurality of conduits being represented by dashed lines [1310], [1311], the passageways of the plurality of the conduits [1310], [1311] collectively forming a first enclosed combustion air passageway [1312]. Further, for example, the passageway of each one of the plurality of the conduits [1310], [1311] in the example [1300] of the aqueous working fluid steam generation system may communicate with a first combustion air input aperture being represented by a dashed line [1404] and with a first combustion air output aperture being represented by a dashed line [1406]; and each one of the plurality of the conduits [1310], [1311] of the first enclosed combustion air passageway [1312] may pass through the first enclosed working fluid chamber [1306]. Additionally, the example [1300] of the aqueous working fluid steam generation system may have an enclosed combustion air chamber [1313] including a working fluid jacket [1314] that contains a second enclosed working fluid chamber [1315]. In the example [1300] of the aqueous working fluid steam generation system, the second enclosed working fluid chamber [1315] may have a second working fluid input aperture being represented by a dashed line [1408] and may have a second working fluid output aperture being represented by a dashed line [1410]. In the example [1300] of the aqueous working fluid steam generation system, the enclosed combustion air chamber [1313] further includes a second enclosed combustion air passageway [1316] communicating with a second combustion air input aperture being represented by a dashed line [1412] and with a second combustion air output aperture being represented by a dashed line [1414]. The example [1300] of the aqueous working fluid steam generation system also includes a burner [1318] being connected to the second combustion air input aperture [1412]. Further, the example [1300] of the aqueous working fluid steam generation system includes another heat exchanger [1320] outside of the pressure vessel [1302]. As examples, the enclosed combustion air chamber [1313], the pressure vessel [1302], the another heat exchanger [1320], and the burner [1318] may have generally cylindrical shapes; and in other examples (not shown), they each independently may have other shapes. In the example [1300] of the aqueous working fluid steam generation system, the another heat exchanger [1320] may include a plurality of conduits being represented by dashed lines [1321], [1322], the passageways of the plurality of the conduits [1321], [1322] collectively forming a third enclosed combustion air passageway [1324]. Further, in the example [1300] of the aqueous working fluid steam generation system, the passageway of each one of the plurality of the conduits [1321], [1322] may communicate with a third combustion air input aperture being represented by a dashed line [1416] and with a third combustion air output aperture being represented by a dashed line [1418]; and each one of the plurality of the conduits [1321], [1322] of the third enclosed combustion air passageway [1324] may pass through a third enclosed working fluid chamber [1325]. Additionally, in examples of the example [1300] of the aqueous working fluid steam generation system, the third enclosed working fluid chamber [1325] may have a third working fluid input aperture being represented by a dashed line [1420] and may have a third working fluid output aperture being represented by a dashed line [1422]. In addition, the example [1300] of the aqueous working fluid steam generation system may include a working fluid conduit, being represented in FIG. 13 by a dashed line [1328], that passes through the first enclosed working fluid chamber [1306] and that connects the third working fluid output aperture [1422] to the second working fluid input aperture [1408]. In the example [1300] of the aqueous working fluid steam generation system, the second working fluid output aperture [1410] is connected to the first working fluid input aperture [1402]; and the second combustion air output aperture [1414] is connected to the first combustion air input aperture [1404]; and the first combustion air output aperture [1406] is connected to the third combustion air input aperture [1416].

In further examples, the example [1300] of the aqueous working fluid steam generation system may be configured for constraining an aqueous working fluid to follow a flow path: from an aqueous working fluid source being schematically represented by a letter "S", through the third working fluid input aperture [1420] as represented by a dashed arrow [1421], into the third enclosed working fluid chamber [1325]; and from the third enclosed working fluid chamber [1325] through the third working fluid output aperture [1422] as represented by a dashed arrow [1423], into the working fluid conduit [1328]; and from the working fluid conduit [1328] through the second working fluid input aperture [1408] as represented by a dashed arrow [1409], into the second enclosed working fluid chamber [1315]; and from the second enclosed working fluid chamber [1315] through the second working fluid output aperture [1410] and the first working fluid input aperture [1402] as represented by a dashed arrow [1403], into the first enclosed working fluid chamber [1306]; and from the first enclosed working fluid chamber [1306] passing through the first working fluid output aperture [1308] as represented by a dashed arrow [1309]. In an example of operation of the example [1300] of the aqueous working fluid steam generation system, for example, a lower portion of the first enclosed working fluid chamber [1306] may be partially filled with an aqueous working fluid so as to keep the heat exchanger [1304] immersed in the aqueous working fluid, while leaving an upper portion of the first enclosed working fluid chamber [1306] above the heat exchanger [1304] available for formation of steam.

In further examples, the example [1300] of the aqueous working fluid steam generation system may include a fan [1424] being connected to the second combustion air input aperture [1412]. As additional examples [1300] of the aqueous working fluid steam generation system, the fan [1424] may be configured for causing the combustion air to follow a flow path being schematically represented by a dashed arrow [1326]: from the burner [1318] through the fan [1424] and the second combustion air input aperture [1412] into the second enclosed combustion air passageway [1316]; and from the second enclosed combustion air passageway [1316] through the second combustion air output aperture [1414] and the first combustion air input aperture [1404] into the first enclosed combustion air passageway [1312]; and from the first enclosed combustion air passageway [1312] through the first combustion air output aperture [1406] and the third combustion air input aperture [1416] into the third enclosed combustion air passageway [1324]; and from the third enclosed combustion air passageway [1324], passing through the third combustion air output aperture [1418]. In some examples, the example [1300] of the aqueous working fluid steam generation system may include a vacuum source [1426] being connected to the third combustion air output aperture [1418]. As further examples [1300] of the aqueous working fluid steam generation system, the vacuum source [1426] may be configured for causing the combustion air to follow the flow path [1326]: from the burner [1318] into the second enclosed combustion air passageway [1316]; and from the second enclosed combustion air passageway [1316] into the first enclosed combustion air passageway [1312]; and from the first enclosed combustion air passageway [1312] into the third enclosed combustion air passageway [1324]; and from the third enclosed combustion air passageway [1324], passing through the third combustion air output aperture [1418]. In some examples [1300] of the aqueous working fluid steam generation system, the vacuum source [1426] may include a fan or an air vacuum pump. In examples of the example [1300] of the aqueous working fluid steam generation system, average temperatures of combustion air may gradually decrease along the flow path [1326] from the second enclosed combustion air passageway [1316] to the third enclosed combustion air passageway [1324]. As further examples of the example [1300] of the aqueous working fluid steam generation system, thermal energy remaining in the combustion air while passing through the third enclosed combustion air passageway [1324] may be transferred into the aqueous working fluid while passing through the third enclosed working fluid chamber [1325]; and then further thermal energy in the combustion air while passing through the second enclosed combustion air passageway [1316] may be transferred into the aqueous working fluid while passing through the second enclosed working fluid chamber [1315]; and then additional thermal energy in the combustion air while passing through the first enclosed combustion air passageway [1312] may be transferred into the aqueous working fluid while passing through the first enclosed working fluid chamber [1306].

Figure 19:
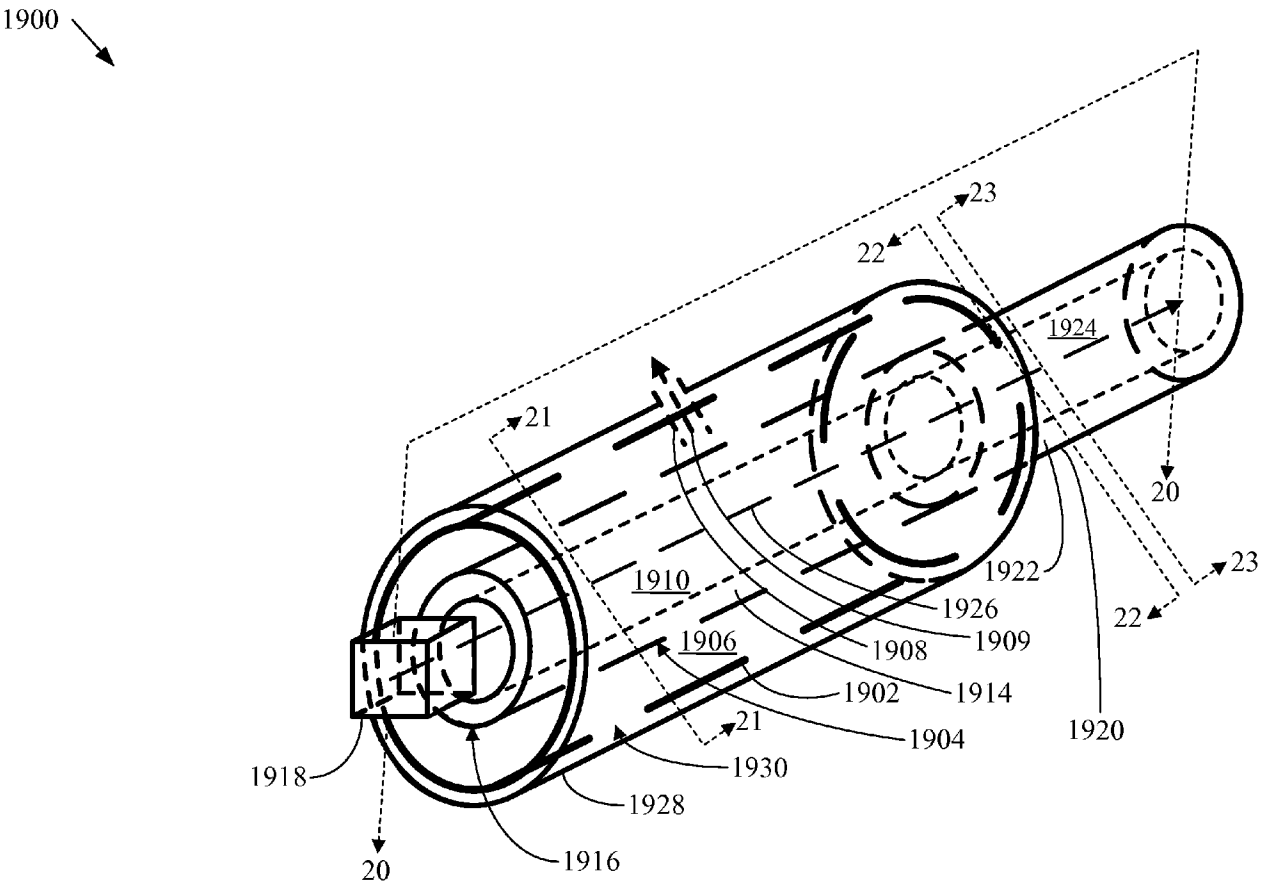
FIG. 19 is a perspective view showing another example [1900] of an implementation of an aqueous working fluid steam generation system.
Figure 20:
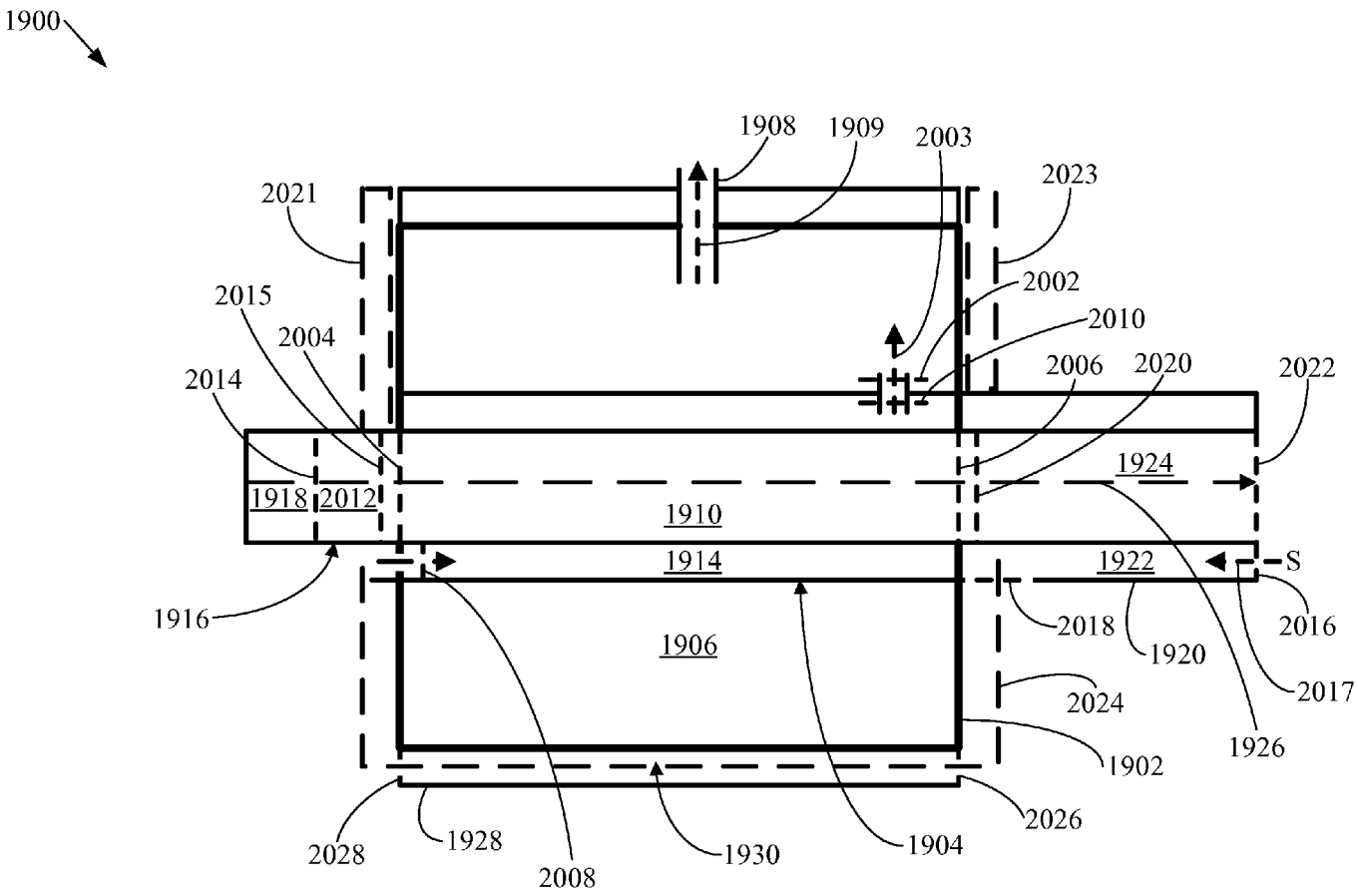
FIG. 20 is a cross-sectional view along the line 20-20 of the example [1900] of the aqueous working fluid steam generation system shown in FIG. 19.
Figure 21:
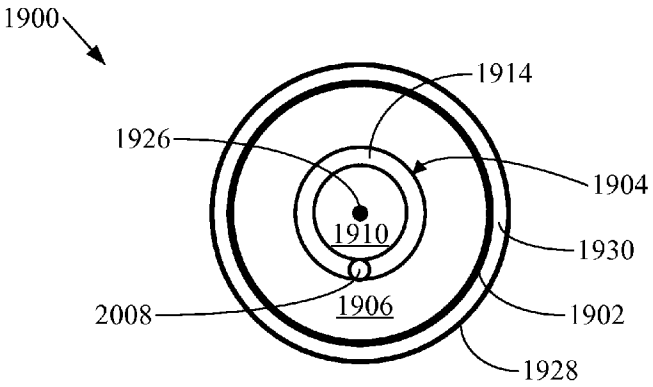
FIG. 21 is a cross-sectional view along the line 21-21 of the example [1900] of the aqueous working fluid steam generation system shown in FIG. 19.
Figure 22:
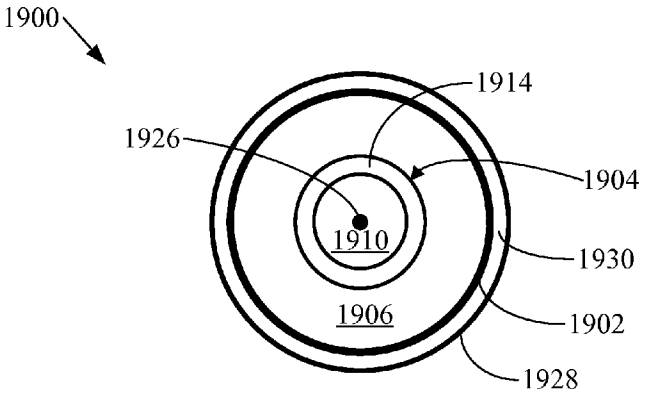
FIG. 22 is a cross-sectional view along the line 22-22 of the example [1900] of the aqueous working fluid steam generation system shown in FIG. 19.
Figure 23:
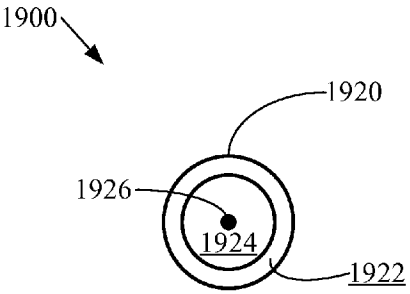
FIG. 23 is a cross-sectional view along the line 23-23 of the example [1900] of the aqueous working fluid steam generation system shown in FIG. 19.

FIG. 19 is a perspective view showing another example [1900] of an implementation of an aqueous working fluid steam generation system. FIG. 20 is a cross-sectional view along the line 20-20 of the example [1900] of the aqueous working fluid steam generation system shown in FIG. 19. FIG. 21 is a cross-sectional view along the line 21-21 of the example [1900] of the aqueous working fluid steam generation system shown in FIG. 19. FIG. 22 is a cross-sectional view along the line 22-22 of the example [1900] of the aqueous working fluid steam generation system shown in FIG. 19. FIG. 23 is a cross-sectional view along the line 23-23 of the example [1900] of the aqueous working fluid steam generation system shown in FIG. 19. It is understood throughout this specification that an example [1900] of an aqueous working fluid steam generation system may include any combination of the features that are discussed herein in connection with the examples [100], [700], [1300], [1900]

of aqueous working fluid steam generation systems. Accordingly, the entireties of the discussions herein of the other examples [100], [700], [1300] of aqueous working fluid steam generation systems are hereby incorporated in this discussion of the examples [1900] of the aqueous working fluid steam generation systems. It is also understood that the examples [1900] of aqueous working fluid steam generation systems may further include any combination of the features that are discussed in the '271 and '005 applications, the entireties of which applications accordingly are hereby incorporated into this discussion of the examples [1900] of aqueous working fluid steam generation systems. As shown in FIGS. 19, 20, 21, 22 and 23, the example [1900] of the implementation of the aqueous working fluid steam generation system includes a pressure vessel [1902] containing a heat exchanger [1904], the heat exchanger [1904] including a first enclosed working fluid chamber [1906] having a first working fluid input aperture represented by a dashed line [2002] and having a first working fluid output aperture [1908]. In the example [1900] of the aqueous working fluid steam generation system, the heat exchanger [1904] further includes a first enclosed combustion air passageway [1910] communicating with a first combustion air input aperture represented by a dashed line [2004] and with a first combustion air output aperture represented by a dashed line [2006], the first enclosed combustion air passageway [1910] passing through the first enclosed working fluid chamber [1906]. Further, in some examples [1900] of the aqueous working fluid steam generation system, the heat exchanger [1904] may further include a second enclosed working fluid chamber [1914] having a second working fluid input aperture represented by a dashed line [2008] and having a second working fluid output aperture represented by a dashed line [2010]. In some examples, the example [1900] of the aqueous working fluid steam generation system may include an enclosed combustion air chamber [1916], which may have a second enclosed combustion air passageway [2012] communicating with a second combustion air input aperture represented by a dashed line [2014] and with a second combustion air output aperture represented by a dashed line [2015]. Additionally in the example [1900] of the aqueous working fluid steam generation system, the heat exchanger [1904] may also function as being a portion of the enclosed combustion air chamber [1916]. The example [1900] of the aqueous working fluid steam generation system also includes a burner [1918] that may be connected to the second combustion air input aperture [2014]. Further, the example [1900] of the aqueous working fluid steam generation system includes another heat exchanger [1920] outside of the pressure vessel [1902], the another heat exchanger [1920] including a third enclosed working fluid chamber [1922] having a third working fluid input aperture represented by a dashed line [2016] and having a third working fluid output aperture represented by a dashed line [2018]. In the example [1900] of the aqueous working fluid steam generation system, the another heat exchanger [1920] further includes a third enclosed combustion air passageway [1924] communicating with a third combustion air input aperture represented by a dashed line [2020] and with a third combustion air output aperture represented by a dashed line [2022]. In addition, the example [1900] of the aqueous working fluid steam generation system includes a working fluid conduit being schematically represented by a dashed arrow [2024], connecting the third working fluid output aperture [2018] to the second working fluid input aperture [2008]. In the example [1900] of the aqueous working fluid steam generation system, the second working fluid output aperture [2010] is connected to the first working fluid input aperture [2002]; and the second combustion air output aperture [2015] is connected to the first combustion air input aperture [2004]; and the first combustion air output aperture [2006] is connected to the third combustion air input aperture [2020].

As examples, the enclosed combustion air chamber [1916], the pressure vessel [1902], and the another heat exchanger [1920] may have generally cylindrical shapes, and the burner [1918] may have a generally box-like shape; and in other examples (not shown), they each independently may have other shapes. In some examples of the example [1900] of the aqueous working fluid steam generation system, a portion of the enclosed combustion air chamber [1916] may be contained by the pressure vessel [1902]. In other examples [1900] of the aqueous working fluid steam generation system, the second enclosed combustion air passageway [2012] may be (not shown) substituted by a portion of the first enclosed combustion air passageway [1910], and the enclosed combustion air chamber [1916] may be completely contained by the pressure vessel [1902]. As additional examples of the example [1900] of the aqueous working fluid steam generation system, the pressure vessel [1902] may be contained by a working fluid jacket [1928] that may form or include a fourth enclosed working fluid chamber [1930]. In further examples of the example [1900] of the aqueous working fluid steam generation system, the working fluid jacket [1928] may be extended as covering some or all further portions of the pressure vessel [1902], such as, for example, by including further portions of the working fluid jacket [1928] being schematically represented by dashed boxes [2021], [2023]. Also in those additional examples of the example [1900] of the aqueous working fluid steam generation system, the fourth enclosed working fluid chamber [1930] may include a fourth aqueous working fluid input aperture represented by a dashed line [2026] and may include a fourth aqueous working fluid output aperture represented by a dashed line [2028]. Further in those additional examples of the example [1900] of the aqueous working fluid steam generation system, the fourth aqueous working fluid input aperture [2026] and the fourth aqueous working fluid output aperture [2028] may be connected to the working fluid conduit [2024]. Additionally in those additional examples of the example [1900] of the aqueous working fluid steam generation system, the fourth enclosed working fluid chamber [1930] may form a portion of the working fluid conduit [2024].

In further examples, the example [1900] of the aqueous working fluid steam generation system may be configured for constraining an aqueous working fluid to follow a flow path: from an aqueous working fluid source being schematically represented by a letter "S", through the third working fluid input aperture [2016] as represented by a dashed arrow [2017], into the third enclosed working fluid chamber [1922]; and from the third enclosed working fluid chamber [1922] through the third working fluid output aperture [2018] and the fourth aqueous working fluid input aperture [2026] and into the working fluid conduit [1930]; and from the working fluid conduit [1930] through the fourth aqueous working fluid output aperture [2028] and the second working fluid input aperture [2008], into the second enclosed working fluid chamber [1914]; and from the second enclosed working fluid chamber [1914] through the second working fluid output aperture [2010] and the first working fluid input aperture [2002] as represented by a dashed arrow [2003], into the first enclosed working fluid chamber [1906]; and from the first enclosed working fluid chamber [1906]

passing through the first working fluid output aperture [1908] as represented by a dashed arrow [1909]. As further examples, the example [1900] of the aqueous working fluid steam generation system may be configured for causing the combustion air to follow a flow path being schematically represented by a dashed arrow [1926]: from the burner [1918] through the second combustion air input aperture [2014] into the second enclosed combustion air passageway [2012]; and from the second enclosed combustion air passageway [2012] through the second combustion air output aperture [2015] and the first combustion air input aperture [2004] into the first enclosed combustion air passageway [1910]; and from the first enclosed combustion air passageway [1910] through the first combustion air output aperture [2006] and the third combustion air input aperture [2020] into the third enclosed combustion air passageway [1924]; and from the third enclosed combustion air passageway [1924], passing through the third combustion air output aperture [2022]. In examples of the example [1900] of the aqueous working fluid steam generation system, average temperatures of combustion air may gradually decrease along the flow path [1926] from the second enclosed combustion air passageway [2012] to the third enclosed combustion air passageway [1924]. As further examples of the example [1900] of the aqueous working fluid steam generation system, thermal energy remaining in the combustion air while passing through the third enclosed combustion air passageway [1924] may be transferred into the aqueous working fluid while passing through the third enclosed working fluid chamber [1922]; and then further thermal energy in the combustion air while passing through the second enclosed combustion air passageway [2012] may be transferred into the aqueous working fluid while passing through the second enclosed working fluid chamber [1914]; and then additional thermal energy in the combustion air while passing through the first enclosed combustion air passageway [1910] may be transferred into the aqueous working fluid while passing through the first enclosed working fluid chamber [1906]. In an example of operation of the example [1900] of the aqueous working fluid steam generation system, for example, a lower portion of the first enclosed working fluid chamber [1906] may be partially filled with an aqueous working fluid so as to keep the heat exchanger [1904] immersed in the aqueous working fluid, while leaving an upper portion of the first enclosed working fluid chamber [1906] above the heat exchanger [1904] available for formation of steam.

The examples [100], [700], [1300], [1900] of aqueous working fluid steam generation systems may generally be utilized in end-use applications for aqueous working fluid steam generation systems where there is a need for efficient transfer of thermal energy, being generated by a burner, to an aqueous working fluid.

While the present invention has been disclosed in a presently defined context, it will be recognized that the present teachings may be adapted to a variety of contexts consistent with this disclosure and the claims that follow. For example, the aqueous working fluid steam generation systems shown in the figures and discussed above can be adapted in the spirit of the many optional parameters described.

What is claimed is:

1. An aqueous working fluid steam generation system comprising:

a pressure vessel containing a heat exchanger, the heat exchanger including a first enclosed working fluid chamber having a first working fluid input aperture and having a first working fluid output aperture, the heat exchanger further including a first enclosed combustion air passageway communicating with a first combustion air input aperture and with a first combustion air output aperture, the first enclosed combustion air passageway passing through the first enclosed working fluid chamber;

an enclosed combustion air chamber including an inner wall being spaced apart from an outer wall, and a second enclosed working fluid chamber being an intervening space between the inner and outer walls of the enclosed combustion air chamber, the second enclosed working fluid chamber having a second working fluid input aperture and having a second working fluid output aperture, the enclosed combustion air chamber further including a second enclosed combustion air passageway communicating with a second combustion air input aperture and with a second combustion air output aperture;

a burner being connected to the second combustion air input aperture;

another heat exchanger outside of the pressure vessel, the another heat exchanger including a third enclosed working fluid chamber having a third working fluid input aperture and having a third working fluid output aperture, the another heat exchanger further including a third enclosed combustion air passageway communicating with a third combustion air input aperture and with a third combustion air output aperture; and a working fluid conduit connecting the third working fluid output aperture to the second working fluid input aperture;

wherein the second working fluid output aperture is connected to the first working fluid input aperture, and wherein the second combustion air output aperture is connected to the first combustion air input aperture, and wherein the first combustion air output aperture is connected to the third combustion air input aperture.

2. An aqueous working fluid steam generation system comprising:

a pressure vessel containing a heat exchanger, the heat exchanger including a first enclosed working fluid chamber having a first working fluid input aperture and having a first working fluid output aperture, the heat exchanger further including a first enclosed combustion air passageway communicating with a first combustion air input aperture and with a first combustion air output aperture, the first enclosed combustion air passageway passing through the first enclosed working fluid chamber;

an enclosed combustion air chamber, the enclosed combustion air chamber being contained by a working fluid jacket, the working fluid jacket being a second enclosed working fluid chamber, the second enclosed working fluid chamber having a second working fluid input aperture and having a second working fluid output aperture, the enclosed combustion air chamber further including a second enclosed combustion air passageway communicating with a second combustion air input aperture and with a second combustion air output aperture;

a burner being connected to the second combustion air input aperture;

another heat exchanger outside of the pressure vessel, the another heat exchanger including a third enclosed working fluid chamber having a third working fluid input aperture and having a third working fluid output aperture, the another heat exchanger further including a third enclosed combustion air passageway communicating with a third combustion air input aperture and with a third combustion air output aperture; and a working fluid conduit connecting the third working fluid output aperture to the second working fluid input aperture:

wherein the second working fluid output aperture is connected to the first working fluid input aperture, and wherein the second combustion air output aperture is connected to the first combustion air input aperture, and wherein the first combustion air output aperture is connected to the third combustion air input aperture.

3. The aqueous working fluid steam generation system of claim 1, wherein the enclosed combustion air chamber is contained by the pressure vessel.

4. The aqueous working fluid steam generation system of claim 1, wherein the first enclosed combustion air passageway of the heat exchanger includes a plurality of conduits each communicating with the first combustion air input aperture and with the first combustion air output aperture, each one of the plurality of the conduits of the first enclosed combustion air passageway passing through the first enclosed working fluid chamber.

5. The aqueous working fluid steam generation system of claim 1, wherein the third enclosed combustion air passageway of the another heat exchanger includes a plurality of conduits each communicating with the third combustion air input aperture and with the third combustion air output aperture, each one of the plurality of the conduits of the third enclosed combustion air passageway passing through the third enclosed working fluid chamber.

6. An aqueous working fluid steam generation system, comprising:

a pressure vessel containing a heat exchanger, the heat exchanger including a first enclosed working fluid chamber having a first working fluid input aperture and having a first working fluid output aperture, the heat exchanger further including a first enclosed combustion air passageway communicating with a first combustion air input aperture and with a first combustion air output aperture, the first enclosed combustion air passageway passing through the first enclosed working fluid chamber, an enclosed combustion air chamber including a second enclosed working fluid chamber having a second working fluid input aperture and having a second working fluid output aperture, the enclosed combustion air chamber further including a second enclosed combustion air passageway communicating with a second combustion air input aperture and with a second combustion air output aperture;

a burner being connected to the second combustion air input aperture;

another heat exchanger outside of the pressure vessel, the another heat exchanger including a third enclosed working fluid chamber having a third working fluid input aperture and having a third working fluid output aperture, the another heat exchanger further including a third enclosed combustion air passageway communicating with a third combustion air input aperture and with a third combustion air output aperture; and a working fluid conduit connecting the third working fluid output aperture to the second working fluid input aperture;

wherein either: (a) the enclosed combustion air chamber includes an inner wall being spaced apart from an outer wall, and the second enclosed working fluid chamber is an intervening space between the inner and outer walls; or (b) the enclosed combustion air chamber is contained by a working fluid jacket, and the working fluid jacket is the second enclosed working fluid chamber;

wherein the second working fluid output aperture is connected to the first working fluid input aperture, and wherein the second combustion air output aperture is connected to the first combustion air input aperture, and wherein the first combustion air output aperture is connected to the third combustion air input aperture;

wherein the aqueous working fluid steam generation system is configured for constraining an aqueous working fluid to follow a flow path: from an aqueous working fluid source into the third enclosed working fluid chamber; and from the third enclosed working fluid chamber into the working fluid conduit; and from the working fluid conduit into the second enclosed working fluid chamber; and from the second enclosed working fluid chamber into the first enclosed working fluid chamber.

7. The aqueous working fluid steam generation system of claim 6, being further configured for constraining the aqueous working fluid to follow the flow path: from the first enclosed working fluid chamber passing through the first working fluid output aperture.

8. The aqueous working fluid steam generation system of claim 7, wherein the pressure vessel includes a valve connected to the first working fluid output aperture; and wherein the valve is configured for controlling a passing of the aqueous working fluid through the first working fluid output aperture.

9. The aqueous working fluid steam generation system of claim 8, wherein the valve is configured for controlling the passing of the aqueous working fluid at an elevated pressure through the first working fluid output aperture.

10. The aqueous working fluid steam generation system of claim 9, wherein the valve is configured for controlling the passing of the aqueous working fluid through the first working fluid output aperture as including aqueous working fluid steam.

11. The aqueous working fluid steam generation system of claim 7, including another working fluid conduit connecting the first working fluid output aperture to the third working fluid input aperture, wherein the pressure vessel includes a valve connected to the first working fluid output aperture; and wherein the valve is configured for controlling a passing of the aqueous working fluid through the first working fluid output aperture; and wherein the another working fluid conduit is configured for controlling a passing of the aqueous working fluid from the first working fluid output aperture into the third enclosed working fluid chamber.

12. The aqueous working fluid steam generation system of claim 7, wherein the working fluid conduit is configured for constraining the aqueous working fluid to follow the flow path into the second enclosed working fluid chamber before a passing of the aqueous working fluid through the first working fluid output aperture.

13. The aqueous working fluid steam generation system of claim 12, wherein the working fluid conduit is contained by the pressure vessel.

14. The aqueous working fluid steam generation system of claim 13, wherein the working fluid conduit passes through the first enclosed working fluid chamber.

15. The aqueous working fluid steam generation system of claim 13, wherein the working fluid conduit is outside of the first enclosed working fluid chamber.

16. The aqueous working fluid steam generation system of claim 15, wherein the working fluid conduit includes a fourth enclosed working fluid chamber being contained by the pressure vessel.

17. The aqueous working fluid steam generation system of claim 16, wherein the pressure vessel includes an inner wall being spaced apart from an outer wall, and wherein the fourth enclosed working fluid chamber is an intervening space between the inner and outer walls of the pressure vessel.

18. The aqueous working fluid steam generation system of claim 17, wherein the first enclosed working fluid chamber is contained by the inner wall of the pressure vessel.

19. The aqueous working fluid steam generation system of claim 12, wherein the working fluid conduit is outside of the pressure vessel.

20. The aqueous working fluid steam generation system of claim 19, wherein the pressure vessel is contained by a working fluid jacket that forms a fourth enclosed working fluid chamber; and wherein the fourth enclosed working fluid chamber includes a fourth aqueous working fluid input aperture and a fourth aqueous working fluid output aperture; and wherein the fourth aqueous working fluid input and output apertures are connected to the working fluid conduit.

21. The aqueous working fluid steam generation system of claim 12, further including a working fluid pressure source being connected to the third working fluid input aperture.

22. The aqueous working fluid steam generation system of claim 21, wherein the working fluid pressure source is configured for causing the aqueous working fluid to follow the flow path: from the aqueous working fluid source into the third enclosed working fluid chamber; and from the third enclosed working fluid chamber into the working fluid conduit; and from the working fluid conduit into the second enclosed working fluid chamber; and from the second enclosed working fluid chamber into the first enclosed working fluid chamber; and from the first enclosed working fluid chamber passing through the first working fluid output aperture.

23. The aqueous working fluid steam generation system of claim 22, wherein the working fluid pressure source includes a fluid pump.

24. An aqueous working fluid steam generation system, comprising:

a pressure vessel containing a heat exchanger, the heat exchanger including a first enclosed working fluid chamber having a first working fluid input aperture and having a first working fluid output aperture, the heat exchanger further including a first enclosed combustion air passageway communicating with a first combustion air input aperture and with a first combustion air output aperture, the first enclosed combustion air passageway passing through the first enclosed working fluid chamber, an enclosed combustion air chamber including a second enclosed working fluid chamber having a second working fluid input aperture and having a second working fluid output aperture, the enclosed combustion air chamber further including a second enclosed combustion air passageway communicating with a second combustion air input aperture and with a second combustion air output aperture;

a burner being connected to the second combustion air input aperture, the burner being configured for causing combustion air to enter the second enclosed combustion air passageway;

another heat exchanger outside of the pressure vessel, the another heat exchanger including a third enclosed working fluid chamber having a third working fluid input aperture and having a third working fluid output aperture, the another heat exchanger further including a third enclosed combustion air passageway communicating with a third combustion air input aperture and with a third combustion air output aperture; and a working fluid conduit connecting the third working fluid output aperture to the second working fluid input aperture;

wherein either: (a) the enclosed combustion air chamber includes an inner wall being spaced apart from an outer wall, and the second enclosed working fluid chamber is an intervening space between the inner and outer walls; or (b) the enclosed combustion air chamber is contained by a working fluid jacket, and the working fluid jacket is the second enclosed working fluid chamber;

wherein the second working fluid output aperture is connected to the first working fluid input aperture, and wherein the second combustion air output aperture is connected to the first combustion air input aperture, and wherein the first combustion air output aperture is connected to the third combustion air input aperture;

wherein the aqueous working fluid steam generation system is configured for constraining the combustion air to follow a flow path: from the burner into the second enclosed combustion air passageway; and from the second enclosed combustion air passageway into the first enclosed combustion air passageway; and from the first enclosed combustion air passageway into the third enclosed combustion air passageway.

25. The aqueous working fluid steam generation system of claim 24, being further configured for constraining the combustion air to follow the flow path: from the third enclosed combustion air passageway passing through the third combustion air output aperture.

26. The aqueous working fluid steam generation system of claim 25, further including a fan being connected to the second combustion air input aperture.

27. The aqueous working fluid steam generation system of claim 26, wherein the fan is configured for causing the combustion air to follow the flow path: from the burner into the second enclosed combustion air passageway; and from the second enclosed combustion air passageway into the first enclosed combustion air passageway; and from the first enclosed combustion air passageway into the third enclosed combustion air passageway; and from the third enclosed combustion air passageway passing through the third combustion air output aperture.

28. The aqueous working fluid steam generation system of claim 25, further including a vacuum source being connected to the third combustion air output aperture.

29. The aqueous working fluid steam generation system of claim 28, wherein the vacuum source is configured for causing the combustion air to follow the flow path: from the burner into the second enclosed combustion air passageway; and from the second enclosed combustion air passageway into the first enclosed combustion air passageway; and from the first enclosed combustion air passageway into the third enclosed combustion air passageway; and from the third enclosed combustion air passageway passing through the third combustion air output aperture.

30. The aqueous working fluid steam generation system of claim 28, wherein the vacuum source includes a fan or an air vacuum pump.

31. An aqueous working fluid steam generation system, comprising:

a pressure vessel containing a heat exchanger, the heat exchanger including a first enclosed working fluid chamber having a first working fluid input aperture and having a first working fluid output aperture, the heat exchanger further including a first enclosed combustion air passageway communicating with a first combustion air input aperture and with a first combustion air output aperture, the first enclosed combustion air passageway passing through the first enclosed working fluid chamber;

an enclosed combustion air chamber including a second enclosed working fluid chamber having a second working fluid input aperture and having a second working fluid output aperture, the enclosed combustion air chamber further including a second enclosed combustion air passageway communicating with a second combustion air input aperture and with a second combustion air output aperture;

a burner being connected to the second combustion air input aperture, the burner being configured for causing combustion air to enter the second enclosed combustion air passageway;

another heat exchanger outside of the pressure vessel, the another heat exchanger including a third enclosed working fluid chamber having a third working fluid input aperture and having a third working fluid output aperture, the another heat exchanger further including a third enclosed combustion air passageway communicating with a third combustion air input aperture and with a third combustion air output aperture; and a working fluid conduit connecting the third working fluid output aperture to the second working fluid input aperture;

wherein either: (a) the enclosed combustion air chamber includes an inner wall being spaced apart from an outer wall, and the second enclosed working fluid chamber is an intervening space between the inner and outer walls; or (b) the enclosed combustion air chamber is contained by a working fluid jacket, and the working fluid jacket is the second enclosed working fluid chamber;

wherein the second working fluid output aperture is connected to the first working fluid input aperture, and wherein the second combustion air output aperture is connected to the first combustion air input aperture, and wherein the first combustion air output aperture is connected to the third combustion air input aperture;

wherein the aqueous working fluid steam generation system is configured for constraining the combustion air to follow a flow path, and being configured for constraining an aqueous working fluid to follow another flow path; wherein a portion of the flow path is countercurrent to a portion of the another flow path; and wherein the portion of the flow path of the combustion air is from the second enclosed combustion air passageway to the third enclosed combustion air passageway; and wherein the portion of the another flow path of the aqueous working fluid is from the third enclosed working fluid chamber to the second enclosed working fluid chamber.

32. The aqueous working fluid steam generation system of claim 13, wherein the burner is configured for causing combustion air to enter the second enclosed combustion air passageway; and wherein the system is configured for constraining the combustion air to follow a flow path and is configured for constraining an aqueous working fluid to follow another flow path; and wherein a portion of the flow path is countercurrent to a portion of the another flow path; and wherein the portion of the flow path of the combustion air is from the second enclosed combustion air passageway to the first enclosed combustion air passageway to the third enclosed combustion air passageway; and wherein the portion of the another flow path of the aqueous working fluid is from the third enclosed working fluid chamber to the working fluid conduit to the second enclosed working fluid chamber.

33. The aqueous working fluid steam generation system of claim 1, including another working fluid conduit connecting the first working fluid output aperture to the third working fluid input aperture, wherein the pressure vessel includes a valve connected to the first working fluid output aperture; and wherein the valve is configured for controlling a passing of the aqueous working fluid through the first working fluid output aperture; and wherein the another working fluid conduit is configured for controlling a passing of the aqueous working fluid from the first working fluid output aperture into the third enclosed working fluid chamber.

34. The aqueous working fluid steam generation system of claim 2, wherein the enclosed combustion air chamber is contained by the pressure vessel.

35. The aqueous working fluid steam generation system of claim 2, wherein the first enclosed combustion air passageway of the heat exchanger includes a plurality of conduits each communicating with the first combustion air input aperture and with the first combustion air output aperture, each one of the plurality of the conduits of the first enclosed combustion air passageway passing through the first enclosed working fluid chamber.

36. The aqueous working fluid steam generation system of claim 2, wherein the third enclosed combustion air passageway of the another heat exchanger includes a plurality of conduits each communicating with the third combustion air input aperture and with the third combustion air output aperture, each one of the plurality of the conduits of the third enclosed combustion air passageway passing through the third enclosed working fluid chamber.

37. The aqueous working fluid steam generation system of claim 2, including another working fluid conduit connecting the first working fluid output aperture to the third working fluid input aperture, wherein the pressure vessel includes a valve connected to the first working fluid output aperture; and wherein the valve is configured for controlling a passing of the aqueous working fluid through the first working fluid output aperture; and wherein the another working fluid conduit is configured for controlling a passing of the aqueous working fluid from the first working fluid output aperture into the third enclosed working fluid chamber.

* * * * *